US010927641B2

(12) United States Patent
Ravensbergen

(10) Patent No.: US 10,927,641 B2
(45) Date of Patent: Feb. 23, 2021

(54) APPARATUSES, SYSTEMS AND METHODS FOR TREATING AND PRODUCING FROM MULTIPLE ZONES IN A SUBTERRANEAN FORMATION

(71) Applicant: NCS Multistage Inc., Calgary (CA)

(72) Inventor: John Ravensbergen, Calgary (CA)

(73) Assignee: NCS Multistage Inc., Calgary (CA)

( * ) Notice: Subject to any disclaimer, the term of this patent is extended or adjusted under 35 U.S.C. 154(b) by 259 days.

(21) Appl. No.: 15/902,671

(22) Filed: Feb. 22, 2018

(65) Prior Publication Data

US 2018/0238140 A1 Aug. 23, 2018

Related U.S. Application Data

(60) Provisional application No. 62/462,245, filed on Feb. 22, 2017.

(51) Int. Cl.
*E21B 34/06* (2006.01)
*E21B 34/14* (2006.01)

(52) U.S. Cl.
CPC ..... *E21B 34/06* (2013.01); *E21B 34/14* (2013.01); *E21B 2200/06* (2020.05)

(58) Field of Classification Search
CPC ..... E21B 34/14; E21B 34/06; E21B 34/063
See application file for complete search history.

(56) References Cited

U.S. PATENT DOCUMENTS

2016/0097257 A1 4/2016 Jani
2016/0312580 A1 10/2016 Nordheimer
2018/0230775 A1* 8/2018 Wood ..... E21B 34/14

* cited by examiner

*Primary Examiner* — Kristyn A Hall
(74) *Attorney, Agent, or Firm* — Ridout and Maybee LLP

(57) ABSTRACT

There is provided apparatuses of a flow communication station a flow control apparatus having a flow control member, and a shifting tool that is configured for coupling to the flow control member. While the shifting tool is coupled to the flow control member, application of a pressure differential across the shifting tool urges movement of the flow control member for effecting opening of a port.

21 Claims, 13 Drawing Sheets

APPARATUSES, SYSTEMS AND METHODS FOR TREATING AND PRODUCING FROM MULTIPLE ZONES IN A SUBTERRANEAN FORMATION

CROSS-REFERENCE TO RELATED APPLICATIONS

This application claims the benefit of priority of U.S. Provisional Patent Application No. 62/462,245 filed Feb. 22, 2017, the entire contents of which is specifically incorporated herein by reference without disclaimer.

FIELD

The present relates to apparatuses, systems and methods for treating a subterranean formations, such as by hydraulic fracturing, and subsequently producing from the subterranean formation.

BACKGROUND

Mechanical actuation of downhole valves can be relatively difficult, owing to the difficulty in deploying shifting tools on coiled tubing, or conventional ball drop systems, for actuating such valves, especially in deviated wellbores. When using conventional ball drop systems, the number of stages that are able to be treated are limited.

DETAILED DESCRIPTION

Figure 1:
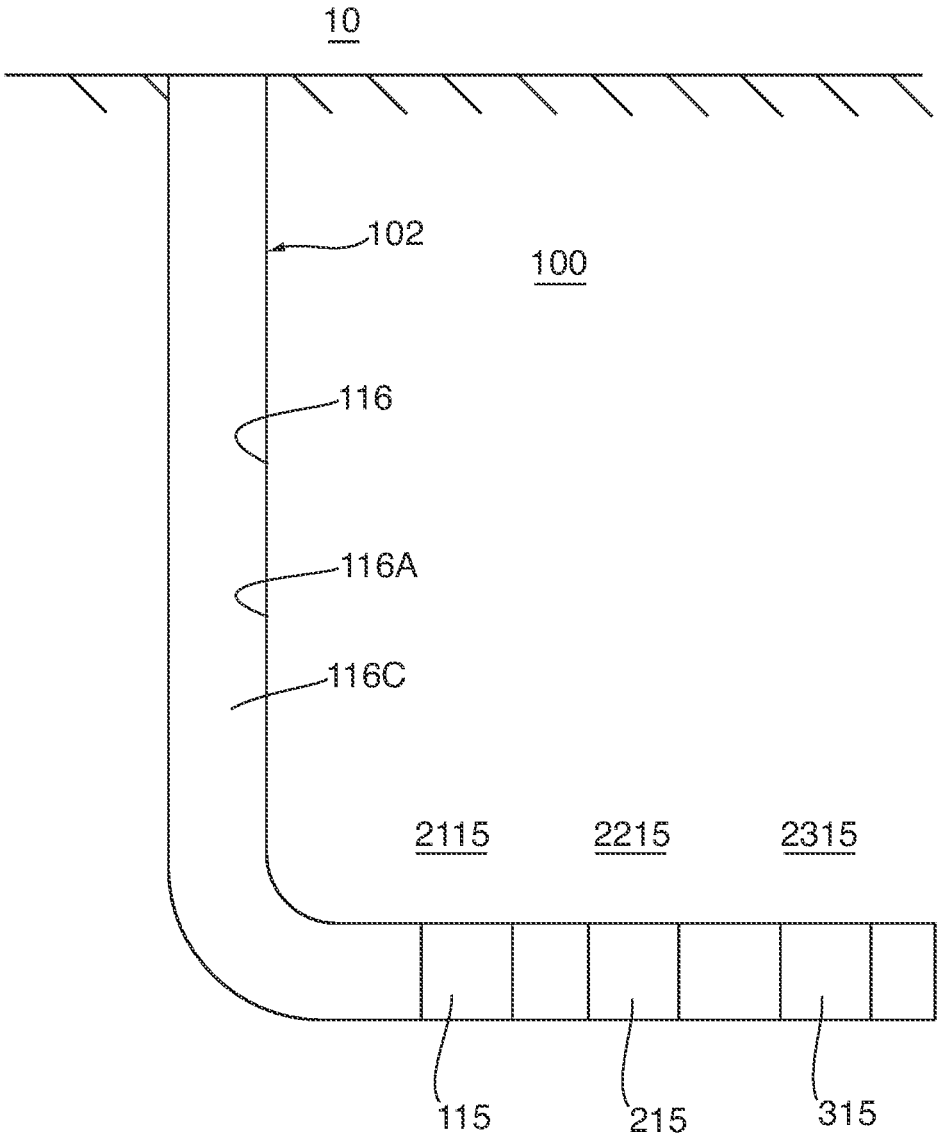
FIGS. 1 and 2 are schematic illustration of a system of the present disclosure.
Figure 2:
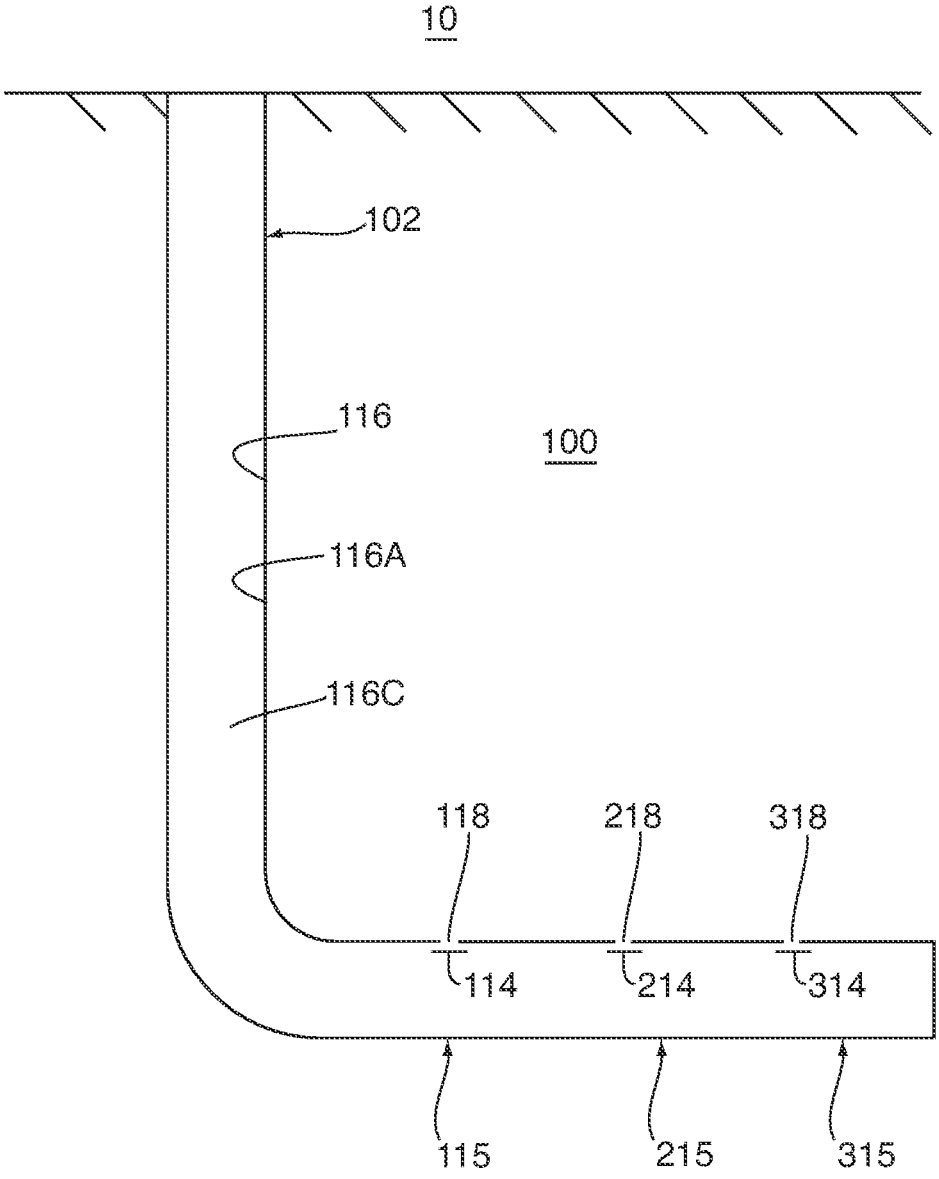

Referring to FIGS. 1 and 2, there is provided a wellbore material transfer system 104 for conducting material from the surface 10 to a subterranean formation 100 via a wellbore 102, from the subterranean formation 100 to the surface 10 via the wellbore 102, or between the surface 10 and the subterranean formation 100 via the wellbore 102. In some embodiments, for example, the subterranean formation 100 is a hydrocarbon material-containing reservoir.

The wellbore 102 can be straight, curved, or branched. The wellbore 102 can have various wellbore sections. A wellbore section is an axial length of a wellbore 102. A wellbore section can be characterized as "vertical" or "horizontal" even though the actual axial orientation can vary from true vertical or true horizontal, and even though the axial path can tend to "corkscrew" or otherwise vary. The term "horizontal", when used to describe a wellbore section, refers to a horizontal or highly deviated wellbore section as understood in the art, such as, for example, a wellbore section having a longitudinal axis that is between 70 and 110 degrees from vertical.

In one aspect, there is provided a process for stimulating hydrocarbon production from the subterranean formation 100. The process includes, amongst other things, conducting stimulation material from the surface 10 to the subterranean formation 100 via the wellbore 102.

In some embodiments, for example, the conducting (such as, for example, by flowing) stimulation material to the subterranean formation 100 via the wellbore 102 is for effecting selective stimulation of the subterranean formation 100, such as a subterranean formation 100 including a hydrocarbon material-containing reservoir. The stimulation is effected by supplying the stimulation material to the subterranean formation 100. In some embodiments, for example, the stimulation material includes a liquid, such as a liquid including water. In some embodiments, for example, the liquid includes water and chemical additives. In other embodiments, for example, the stimulation material is a slurry including water and solid particulate matter, such as proppant. In some embodiments, for example the stimulation material includes chemical additives. Exemplary chemical additives include acids, sodium chloride, polyacrylamide, ethylene glycol, borate salts, sodium and potassium carbonates, glutaraldehyde, guar gum and other water soluble gels, citric acid, and isopropanol. In some embodiments, for example, the stimulation material is supplied to effect hydraulic fracturing of the reservoir.

In some embodiments, for example, the conducting of fluid, to and from the wellhead, is effected by a wellbore string 116. The wellbore string 116 may include pipe, casing, or liner, and may also include various forms of tubular segments, such as the flow communication stations 115, 215 described herein. The wellbore string 116 defines a wellbore string passage 116C.

In some embodiments, for example, the wellbore 102 includes a cased-hole completion, in which case, the wellbore string 116 includes a casing 116A.

A cased-hole completion involves running casing down into the wellbore 102 through the production zone. The casing 116A at least contributes to the stabilization of the subterranean formation 100 after the wellbore 102 has been completed, by at least contributing to the prevention of the collapse of the subterranean formation 100 that is defining the wellbore 102. In some embodiments, for example, the casing 116A includes one or more successively deployed concentric casing strings, each one of which is positioned within the wellbore 102, having one end extending from the well head 50. In this respect, the casing strings are typically run back up to the surface. In some embodiments, for example, each casing string includes a plurality of jointed segments of pipe. The jointed segments of pipe typically have threaded connections.

The annular region between the deployed casing 116A and the subterranean formation 100 may be filled with zonal isolation material 111 for effecting zonal isolation. The zonal isolation material is disposed between the casing 116A and the subterranean formation 100 for the purpose of effecting isolation, or substantial isolation, of one or more zones of the subterranean formation from fluids disposed in another zone of the subterranean formation. Such fluids include formation fluid being produced from another zone of the subterranean formation 100 (in some embodiments, for example, such formation fluid being flowed through a production string disposed within and extending through the casing 116A to the surface), or injected stimulation material. In this respect, in some embodiments, for example, the zonal isolation material is provided for effecting sealing, or substantial sealing, of flow communication between one or more zones of the subterranean formation and one or more others zones of the subterranean formation via space between the casing 116A and the subterranean formation 100. By effecting the sealing, or substantial sealing, of such flow communication, isolation, or substantial isolation, of one or more zones of the subterranean formation 100, from another subterranean zone (such as a producing formation) via the is achieved. Such isolation or substantial isolation is desirable, for example, for mitigating contamination of a water table within the subterranean formation by the formation fluids (e.g. oil, gas, salt water, or combinations thereof) being produced, or the above-described injected fluids.

In some embodiments, for example, the zonal isolation material is disposed as a sheath within an annular region between the casing 116A and the subterranean formation 100. In some embodiments, for example, the zonal isolation material is bonded to both of the casing 116A and the subterranean formation 100. In some embodiments, for example, the zonal isolation material also provides one or more of the following functions: (a) strengthens and reinforces the structural integrity of the wellbore, (b) prevents, or substantially prevents, produced formation fluids of one zone from being diluted by water from other zones. (c) mitigates corrosion of the casing 116A, and (d) at least contributes to the support of the casing 116A. The zonal isolation material is introduced to an annular region between the casing 116A and the subterranean formation 100 after the subject casing 116A has been run into the wellbore 102. In some embodiments, for example, the zonal isolation material includes cement.

For wells that are used for producing reservoir fluid, few of these actually produce through wellbore casing. This is because producing fluids can corrode steel or form undesirable deposits (for example, scales, asphaltenes or paraffin waxes) and the larger diameter can make flow unstable. In this respect, a production string is usually installed inside the last casing string. The production string is provided to conduct reservoir fluid, received within the wellbore, to the wellhead 116. In some embodiments, for example, the annular region between the last casing string and the production tubing string may be sealed at the bottom by a packer.

In some embodiments, for example, the conduction of fluids between the surface 10 and the subterranean formation 100 is effected via the passage 116C of the wellbore string 116.

In some embodiments, for example, the conducting of the stimulation material to the subterranean formation 100 from the surface 10 via the wellbore 102, or of hydrocarbon material from the subterranean formation 100 to the surface 10 via the wellbore 102, is effected via one or more flow communication stations (three flow communications 115, 215, 315 are illustrated) that are disposed at the interface between the subterranean formation 100 and the wellbore 102. Successive flow communication stations 115, 215, 315 may be spaced from each other along the wellbore 102 such that each one of the flow communication stations 115, 215, 315, independently, is positioned adjacent a zone or interval of the subterranean formation 100 for effecting flow communication between the wellbore 102 and the zone (or interval).

For effecting the flow communication, the flow communication station 115 (215, 315) includes one or more ports 118 (218, 318) through which the conducting of the material is effected. In some embodiments, for example, the ports 118 (218, 318) are disposed within a sub that has been integrated within the wellbore string 116, and are pre-existing, in that the ports 118 (218, 318) exists before the sub, along with the wellbore string 116, has been installed downhole within the wellbore string 116. In some embodiments, for example, the ports 118 (218, 318) are defined by perforations within the wellbore string 116, and the perforations are created after the wellbore string 116 has been installed within the wellbore string 116, such as by a perforating gun.

In some embodiments, for example, the flow communication station 115 (215, 315) includes a flow control apparatus 115A (215A, 315A). Referring to FIGS. 3 to 6, the flow control apparatus 115A (215A, 315A) includes a housing 117 (217, 317). The housing 117 (217, 317) includes a passage 132 (232, 332) and the one or more ports 118 (218). The passage 132 (232, 332) extends from an uphole end 115B (215B, 315B) of the flow control apparatus 115A (215A, 315A) to a downhole end 115C (215C, 315C) of the flow control apparatus 115A (215A, 315A) The flow control apparatus 115A (215A, 315A) is configured for integration within the wellbore string 116 such that the wellbore string passage 116C includes the passage 132 (232, 332). The integration may be effected, for example, by way of threading or welding.

Figure 3:
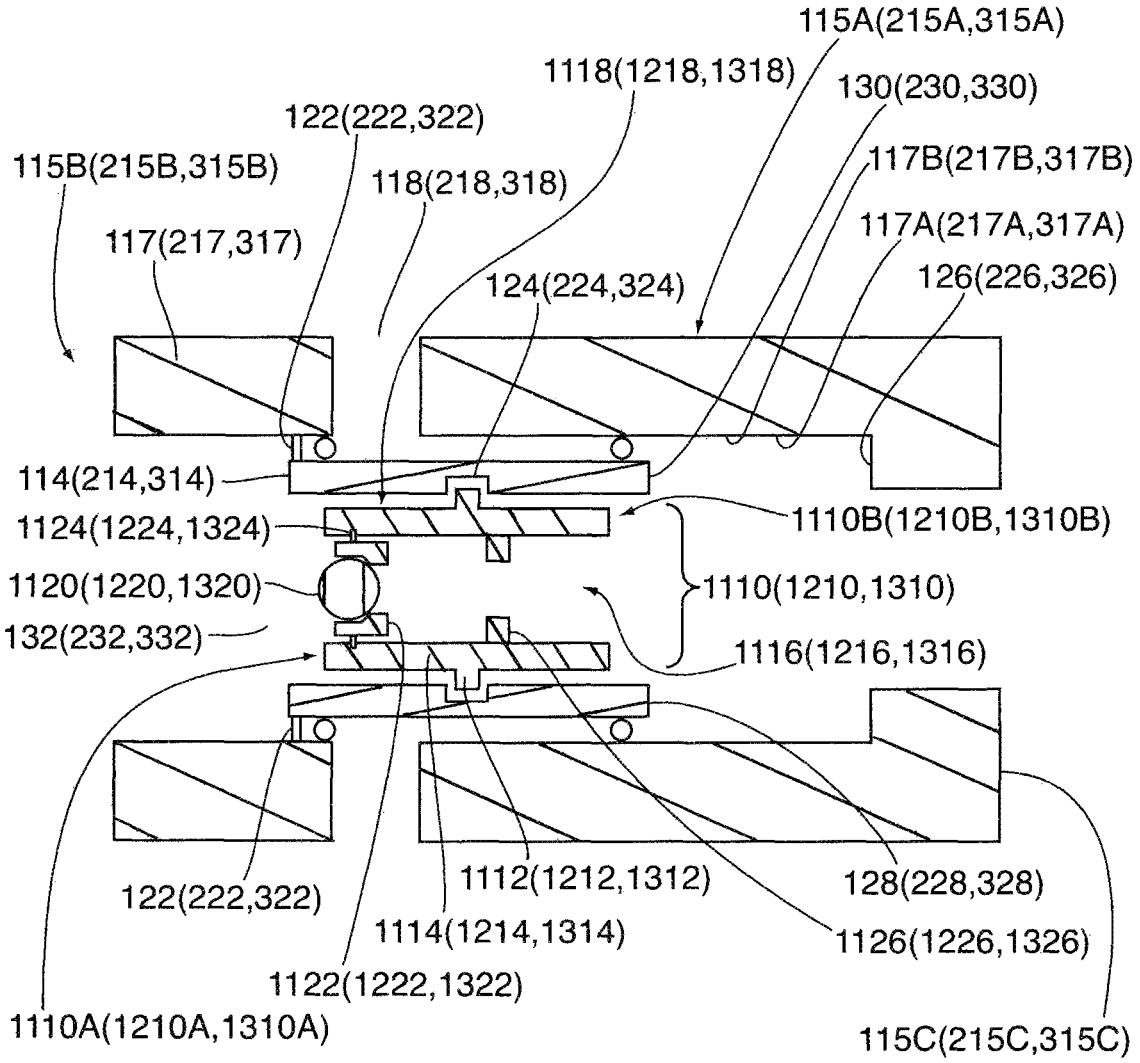
FIG. 3 is a schematic illustration of an assembly of a shifting tool disposed within the flow control apparatus, while the flow control member is disposed in the closed position.
Figure 4:
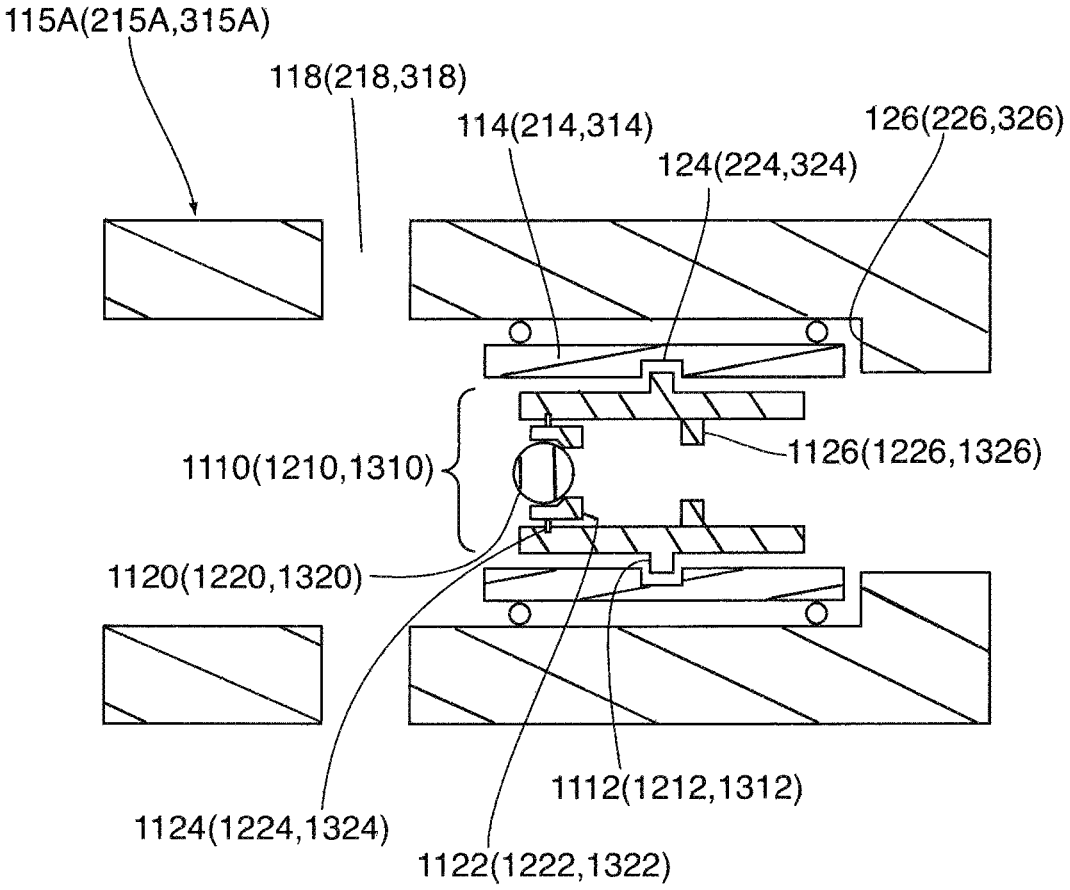
FIG. 4 is a schematic illustration of the assembly illustrated in FIG. 2, with the flow control member having been displaced to the open position.
Figure 5:
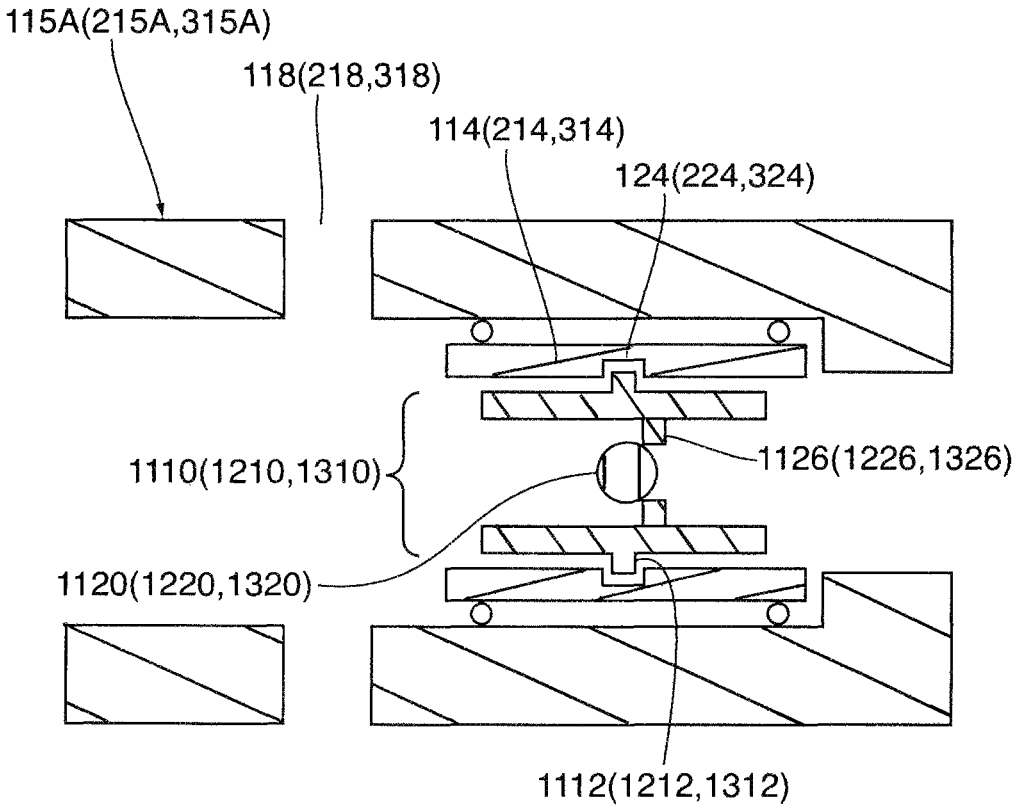
FIG. 5 is a schematic illustration of the assembly illustrated in FIG. 2, with the flow communication interference body having become released and seated against a hard stop in the flow control member coupler retaining position.
Figure 6:
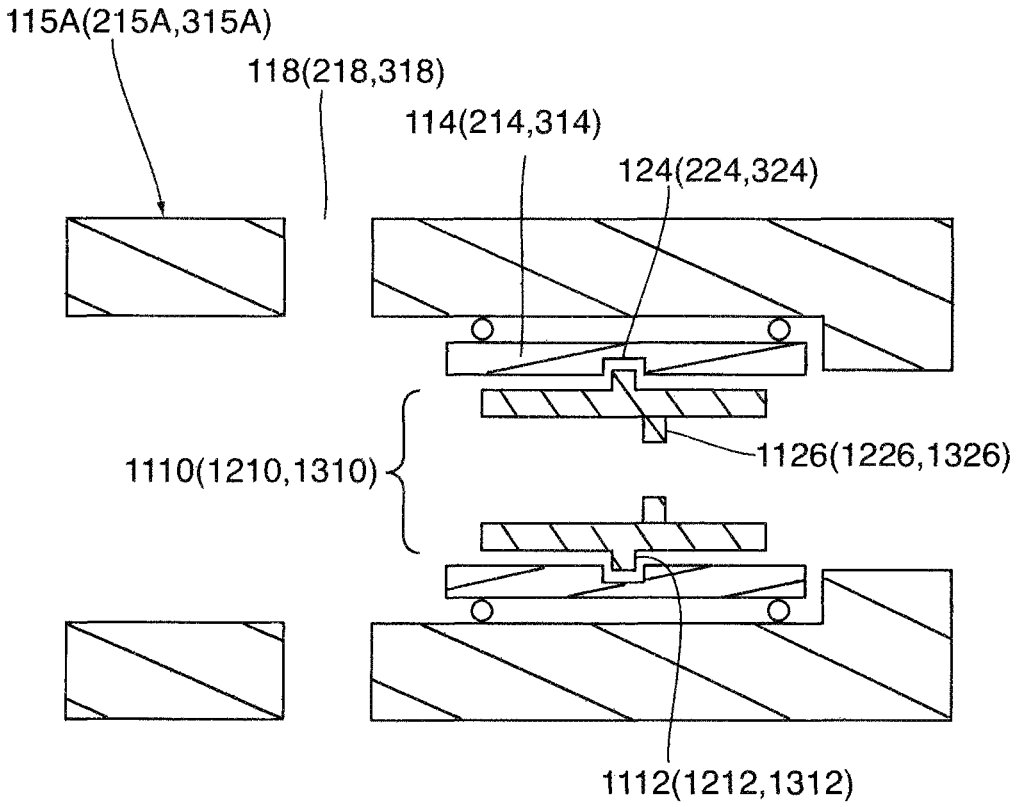
FIG. 6 is a schematic illustration of the assembly illustrated in FIG. 2, after the flow communication interference body having become released, seated against a hard stop in the flow control member coupler retaining position, and then dissolved within wellbore fluids.

The flow control apparatus 115A (215A, 315A) includes a flow control member 114 (214, 314) disposed within the passage 132 (232, 332) for controlling the conducting of material by the flow control apparatus 115A (215A, 315A) via the one or more ports 118 (218, 318). The flow control member 114 (214, 314) is displaceable, relative to the one or more ports 118 (218, 318), for effecting opening of the one or more ports 118 (218, 318). In some embodiments, for example, the flow control member 114 (214, 314) is also displaceable, relative to the one or more ports 118 (218, 318), for effecting closing of the one or more ports 118 (218, 318). In this respect, the flow control member 114 (214, 314) is displaceable from a closed position to an open position. Referring to FIGS. 4 to 6, the open position of the flow control member 114 (214, 314) corresponds to an open condition of the one or more ports 118 (218, 318). Referring to FIG. 3, the closed position of the flow control member 114 (214, 314) corresponds to a closed condition of the one or more ports 118 (218, 318).

Referring to FIG. 3, in some embodiments, for example, in the closed position, the one or more ports 118 (218, 318) are covered by the flow control member 114 (214, 314), and the displacement of the flow control member 114 (214, 314) to the open position effects at least a partial uncovering of the one or more ports 118 (218, 318) such that the one or more ports 118 (218, 318) become disposed in the open condition. In some embodiments, for example, in the closed position, the flow control member 114 (214, 314) is disposed, relative to the one or more ports 118 (218, 318), such that a sealed interface is disposed between the passage 132 (232, 332) and the subterranean formation 100, and the disposition of the sealed interface is such that the conduction of material between the passage 132 (232, 332) and the subterranean formation 100, via the flow communication station 115 (215, 315) is prevented, or substantially prevented, and displacement of the flow control member 114 (214, 314) to the open position effects flow communication, via the one or more ports 118 (218, 318), between the passage 132 (232, 332) and the subterranean formation 100, such that the conducting of material between the passage 132 (232, 332) and the subterranean formation 100, via the flow communication station, is enabled. In some embodiments, for example, the sealed interface is established by sealing engagement between the flow control member 114 (214, 314) and the housing 117 (217, 317). In some embodiments, for example, the flow control member 114 (214, 314) includes a sleeve. The sleeve is slideably disposed within the passage 116C.

The passage 132 (232, 332), the ports 118 (218, 318), and the flow control member 114 (214, 314) are co-operatively configured such that, while the flow control member 114 (214, 314) is disposed in the open position, flow communication is established, via the passage 132 (232, 332), between the passage 132 (232, 332) and the one or more ports 118 (218, 318).

In some embodiments, for example, the flow control member 114 (214, 314) is initially installed retained in the closed position. In this respect, the flow control member 114 (214, 314) is retained in the closed position by one or more frangible interlocking members 122 (222, 322) that are secured to the housing, such that the flow control member 114 (214, 314) is releasably coupled to the housing. In some embodiments, for example, the one or more fragible members include one or more shear pins. The retained flow control member 114 (214, 314) is configured for becoming disposed in a displaceable condition, with effect that the flow control member 114 (214, 314) is displaceable from the closed position to the open position, in response to fracturing of the one or more frangible interlocking members 122 (222, 322).

The fracturing of the one or more frangible interlocking members 122 (222, 322) is effected by transmission of a force applied to a shifting tool 1110 (1210, 1310) in response to fluid pressure, such as an unbalanced fluid pressure applied to the shifting tool 1110 (1210, 1310). In some embodiments, for example, the unbalanced fluid pressure is at least 500 psi. In some embodiments, for example, the unbalanced fluid pressure is applied by fluid that is supplied into the wellbore string passage 116C, such as fluid that is supplied from the surface.

In some embodiments, for example, the shifting tool 1110 (1210, 1310) is configured for coupling to the flow control member 114 (214, 314). The shifting tool 1110 (1210, 1310) includes a flow control member coupler 1112 (1212, 1312) for coupling to the flow control member 114 (214, 314).

In some embodiments, for example, the flow control member 114 (214, 314) includes a receiving profile 124 (224, 324) for receiving the flow control member coupler 1112 (1212, 1312). The flow control member coupler 1112 (1212, 1312) is displaceable between a released position and a retained position. The receiving profile 124 (224, 324) and the flow control member coupler 1112 (1212, 1312) are co-operatively configured such that, while the flow control member coupler 1112 (1212, 1312) is disposed in the retained position, the flow control member coupler 1112 (1212, 1312) is disposed in the receiving profile 124 (224, 324) with effect that the flow control member coupler 1112 (1212, 1312) is coupled to the flow control member 114 (214, 314), such that release of the flow control member coupler 1112 (1212, 1312), from the flow control member 114 (214, 314), by displacement of the flow control member 114 (214, 314) along an axis that is parallel to, or substantially parallel to, a longitudinal axis of the shifting tool 1110 (1210, 1310) (such as, for example, along an axis that is parallel to, or substantially parallel to, a longitudinal axis of the passage of the shifting tool 1110 (1210, 1310)—see below), is prevented or substantially prevented.

In some embodiments, for example, the receiving profile 124 (224, 324) and the flow control member coupler 1112 (1212, 1312) are further co-operatively configured such that, while the flow control member coupler 1112 (1212, 1312) is disposed in the retained position, the flow control member coupler 1112 (1212, 1312) is disposed in the receiving profile 124 (224, 324) with effect that the flow control member coupler 1112 (1212, 1312) is releasably coupled to the flow control member 114 (214, 314), such that release of the flow control member coupler 1112 (1212, 1312), from the flow control member 114 (214, 314), by displacement of the flow control member coupler 1112 (1212, 1312) inwardly towards a longitudinal axis of the shifting tool 1110 (1210, 1310) (such as, for example, towards a longitudinal axis of the passage of the shifting tool 1110 (1210, 1310), such as, for example, along an axis that is perpendicular to, or substantially perpendicular to, a longitudinal axis of the shifting tool 1110 (1210, 1310), such as, for example, along an axis that is perpendicular to, or substantially perpendicular to, a longitudinal axis of the passage of the shifting tool 1110 (1210, 1310)), is effectible.

In some embodiments, for example, the receiving profile 124 (224, 324) includes a recess, such as, for example, a groove, within the surface of the flow control member 114 (214, 314).

In some embodiments, for example, the shifting tool 1110 (1210, 1310) includes one or more resilient members 1114 (1214, 1314) that exert a biasing force for effecting the biasing of the flow control member coupler 1112 (1212, 1312) to the retained position. In this respect, the flow control member 114 (214, 314) is displaceable, by virtue of the bias, from the released position to the retained position. In some embodiments, for example, the displaceability of the flow control member coupler 1112 (1212, 1312) from the released position to the retained position is outwardly relative to the longitudinal axis of the shifting tool 1110 (1210, 1310) (such as, for example, outwardly relative to a longitudinal axis of the passage of the shifting tool 1110 (1210, 1310)). In some embodiments, for example, the displaceability of the flow control member coupler 1112 (1212, 1312) from the released position to the retained position is along an axis that is perpendicular to, or substantially perpendicular to, the longitudinal axis of the shifting tool 1110 (1210, 1310) (such as, for example, the longitudinal axis of the passage of the shifting tool 1110 (1210, 1310)).

In some embodiments, for example, the resilient members 1114 (1214, 1314) are in the form of collet springs (for example, beam springs), that are separated by slots. In some contexts, the collet springs may be referred to as collet fingers. In some embodiments, for example, the flow control member coupler 1112 (1212, 1312) is disposed on one or more of the collet springs. In some embodiments, for example, the flow control member coupler 1112 (1212, 1312) includes a protuberance extending from the collet spring, such as an engagement block.

In some embodiments, for example, the collet springs 1114 (1214, 1314) are configured for a limited amount of compression in response to a compressive force applied inwardly relative to a longitudinal axis of the shifting tool 1110 (1210, 1310). Because of their resiliency, the collet springs are able to pass by a restriction within the wellbore string 116 while returning to its original shape.

In this respect, when the flow control member coupler 1112 (1212, 1312) becomes aligned with the receiving profile 124 (224, 324) of the flow control member 114 (214, 314), after traversing a section of the wellbore string 116 while in a compressed state, the collet springs 1014, (2014, 3014) expand with effect that the flow control member coupler 1112 (1212, 1312) is displaced outwardly relative to the longitudinal axis of the shifting tool 1110 (1210, 1310) (such as, for example, the longitudinal axis of the passage of the shifting tool 1110 (1210, 1310), such as, for example, the longitudinal axis of the passage of the shifting tool 1110 (1210, 1310)), towards the receiving profile 124 (224, 324), for disposition within the receiving profile 124 (224, 324) in the retained position.

In some embodiments, for example, the housing 117 (217, 317) includes a stop 126 (226, 326), such as, for example, in the form of a shoulder, for preventing, or substantially preventing, displacement of the flow control member 114 (214, 314), relative to the one or more ports 118 (218, 318), in a downhole direction. The stop and the one or more ports 118 (218, 318) are co-operatively positioned such that, the preventing, or substantial preventing, of displacement of the flow control member 114 (214, 314), relative to the one or more ports 118 (218, 318), in a downhole direction, is effectible only while the one or more ports 118 (218, 318) are disposed in the open condition (such as, for example, after the opening of the one or more ports 118 (218, 318)). In some embodiments, for example, the preventing displacement is effectible while the flow control member 114 (214, 314) is coupled to the stop 126 (226, 326) (such as, for example, by being disposed in contact engagement with a surface that is intermediate the flow control member 114 (214, 314) and the stop), such as, for example, while the flow control member 114 (214, 314) is disposed in contact engagement with the stop.

In some embodiments, for example, the fracturing of the one or more frangible interlocking members 122 (222, 322), and subsequent displacement of the flow control member 114 (214, 314), relative to the one or more ports 118 (218, 318), by the shifting tool 1110 (1210, 1310), is effectible in response to fluid pressure, such as, for example, in response to application of an unbalanced fluid pressure by a very high pressure fluid. By virtue of the continued application of an unbalanced pressure force after the fracturing of the one or more frangible interlocking members 122 (222, 322), a significantly high force is potentially transmittable to the flow control member coupler 1112 (1212, 1312) in response to the coupling of the flow control member 114 (214, 314) to the stop. Such force, if sufficiently strong, could effect release of the flow control member coupler 1112 (1212, 1312) from the receiving profile 124 (224, 324) of the flow control member 114 (214, 314), such that uncoupling of the shifting tool 1110 (1210, 1310) from the flow control member 114 (214, 314) is effected. Uncoupling of the shifting tool 1110 (1210, 1310) from the flow control member 114 (214, 314) could compromise isolation of a zone downhole from the zone associated with the flow communication station whose flow control member 114 (214, 314) has become uncoupled from the shifting tool 1110 (1210, 1310).

In some embodiments, for example, the flow control member 114 (214, 314) and the flow control member coupler 1112 (1212, 1312) are co-operatively configured such that: (i) a displacement-ready flow control member assembly 2000 is defined while the flow control member coupler 1112 (1212, 1312) is coupled to the flow control member 114 (214, 314), and (ii) the displacement-ready flow control member 114 (214, 314) assembly includes the flow control member 114 (214, 314) and the flow control member coupler 1112 (1212, 1312), and in some of these embodiments, for example, the system further includes an energy absorber 2010 configured for absorbing energy from the displacement-ready flow control member assembly 2000 while the displacement-ready flow control member assembly 2000 is in motion (such as, for example, in response to the application of an unbalanced fluid pressure, such as, for example, in response to the application of an unbalanced fluid pressure that is effecting the displacement of the flow control member 114 (214, 314) to the open position, such as, for example, in response to the continued application of an unbalanced fluid pressure that has effected the displacement of the flow control member 114 (214, 314) to the open position) and is being decelerated by the stop. In some of these embodiments, for example, at least 75% of the kinetic energy of the displacement-ready flow control member assembly 2000, being displaced, is absorbed by the energy absorber. In some of these embodiments, for example, at least 90% of the kinetic energy of the displacement-ready flow control member assembly 2000, being displaced, is absorbed by the energy absorber.

In some embodiments, for example, the energy absorber 2010 includes a shock absorber configured for mitigating a shock load being transmitted to the flow control member coupler 1112 (1212, 1312), urging the release of the flow control member coupler 1112 (1212, 1312) from the receiving profile 124 (224, 324) of the flow control member 114 (214, 314), while the flow control member 114 (214, 314) is in motion (such as, for example, in response to the application of an unbalanced fluid pressure, such as, for example, in response to the application of an unbalanced fluid pressure that is effecting the displacement of the flow control member 114 (214, 314) to the open position, such as, for example, in response to the continued application of an unbalanced fluid pressure after the unbalanced fluid pressure has effected the displacement of the flow control member 114 (214, 314) to the open position) and is being decelerated by the stop 126 (226, 326).

In some embodiments, for example, the energy absorber 2110 (2210, 2310) includes a brake. In some of these embodiments, for example, the brake is defined by a frictionally-engaging portion 117A (217A, 317A) that is configured for frictionally engaging the flow control member 114 (214, 314), such that the frictionally engaging portion becomes disposed in an interference fit relationship with the flow control member 114 (214, 314), as the flow control member 114 (214, 314) is being displaced by the shifting tool 1110 (1210, 1310) from the closed position. The frictionally-engaging portion 117A (217A, 317A) of the housing 117 (217, 317) is disposed uphole of the stop 126 (226, 326), such that the frictional engagement is effected prior to coupling of the flow control member 114 (214, 314) to the stop 126 (226, 326).

In some embodiments, for example, flow control member 114 (214, 314) and the frictionally-engaging portion 117A (217A, 317A) are co-operatively configured such that, while flow control member 114 (214, 314) is being displaced from the closed position, the distance over which the flow control member 114 (214, 314) is displaced, while disposed in an interference fit relationship with the frictionally-engaging portion 117A (217A, 317A), is at least 0.1 inches, such as, for example, at least 0.25 inches, such as, for example, at least 0.5 inches.

In some embodiments, for example, the frictionally-engaging portion 117A (217A, 317A) engages the flow control member 114 (214), and becomes disposed in the interference fit relationship, as the flow control member 114 (214) is being displaced by the shifting tool 1110 (1210, 1310) from the closed position with effect that frictional engagement of the flow control member 114 (214, 314) increases (for at least a portion of the displacement) while the flow control member 114 (214, 314) is being displaced from the closed position. In some embodiments, for example, the frictionally-engaging portion 117A (217A, 317A) includes a portion that is tapered inwardly, relative to a longitudinal axis of the passage 132 (232, 332). In some embodiments, for example, the frictionally-engaging portion 117A (217A, 317A) defines a wedge.

The passage portion 132A (232A, 332A) defined by the frictionally-engaging portion 117A (217A, 317A) has a cross-sectional area that is smaller than the cross-sectional area of the passage portion 132B (232B, 332B) at the one or more ports 118 (218, 318) In some embodiments, for example, the housing 117 (217, 317) includes a transition portion 117B (217B, 317B) disposed between the one or more ports 118 (218, 318) 118 and the frictionally-engaging portion 117A (217A, 317A) and the transition portion 117B (217B, 317B) defines an interior surface that is tapered inwardly, relative to the central longitudinal axis of the passage 132, (232, 332), towards the frictionally-engaging portion 117A (217A, 317A).

Also in this respect, in some embodiments, for example, the energy absorber 2010 includes a crumple zone 128 (228, 328) that is defined on a portion of the flow control member 114 (214, 314), between the receiving profile 124 (224, 324) and the leading downhole edge 130 (230, 330) of the flow control member 114 (214, 314). In some embodiments, for example, the crumple zone 128 (228, 328) is defined on the leading downhole edge 130 (230, 330) of the flow control member 114 (214, 314).

In some embodiments, for example, the shifting tool 1110 (1210, 1310) is disposable between a flow communication-interference condition and a flow communication-effecting condition.

In some embodiments, for example, the shifting tool 1110 (1210, 1310) is disposable from a flow communication interference condition (see FIGS. 3 to 5) to a flow communication-effecting condition (see FIG. 6).

In some embodiments, for example, the flow control member 114 (214, 314) and the shifting tool 1110 (1210, 1310) are co-operatively configured such that, while: (i) the shifting tool 1110 (1210, 1310) is coupled to the flow control member 114 (214, 314), and (ii) the shifting tool 1110 (1210, 1310) is disposed in the flow communication interference condition, the passage 132 (232, 332) is closed or substantially closed.

In some embodiments, for example, the flow control member 114 (214, 314) and the shifting tool 1110 (1210, 1310) are co-operatively configured such that, while: (i) the shifting tool 1110 (1210, 1310) is releasably coupled to the flow control member 114 (214, 314), and (ii) the shifting tool 1110 (1210, 1310) is disposed in the flow communication interference condition, flow communication, via the passage 132 (232, 332), between the uphole end 115B (215B, 315B) of the flow control apparatus 115A (215A, 315A) and the downhole end 115C (215C, 315C) of the flow control apparatus 115A (215A, 315A), is sealed or substantially sealed.

In some embodiments, for example, the flow control member 114 (214, 314) and the shifting tool 1110 (1210, 1310) are co-operatively configured such that, while: (i) the shifting tool 1110 (1210, 1310) is coupled to the flow control member 114 (214, 314), and (ii) the shifting tool 1110 (1210, 1310) is disposed in the flow communication interference condition, a sealed interface is established within the passage 132 (232, 332).

In some of these embodiments, for example, the flow control member 114 (214, 314) and the shifting tool 1110 (1210, 1310) are also co-operatively configured such that, while: (i) the shifting tool 1110 (1210, 1310) is coupled to the flow control member 114 (214, 314), and (ii) the shifting tool 1110 (1210, 1310) is disposed in the flow communication-effecting condition, flow communication, via the passage 132 (232, 332), between the uphole end 115B (215B, 315B) of the flow control apparatus 115A (215A, 315A) and the downhole end 115C (215C, 315C) of the flow control apparatus 115A (215A, 315A), is established.

In some embodiments, for example, the shifting tool 1110 (1210, 1310) includes a shifting tool housing 1118 (1218, 1318) having a passage 1116 (1216, 1316) extending from a first end 1110A (1210A, 1310A) (the uphole end) of the shifting tool 1110 (1210, 1310) to a second end 1110B (1210B, 1310B) (downhole end) of the shifting tool 1110 (1210, 1310). The passage 1116 (1216, 1316) is defined within the shifting tool housing 1118 (1218, 1318), such as, for example, by an inner surface of the housing 1118 (1218, 1318) of the shifting tool 1110 (1210, 1310).

In some embodiments, for example, the shifting tool 1110 (1210, 1310) includes a flow communication interference body 1120 (1220, 1320) disposed within the passage 1116 (1216, 1316) of the housing. In some embodiments, for example, the flow communication interference body 1120 (1220, 1320) and the passage 1116 (1216, 1316) are co-operatively configured such that the shifting tool 1110 (1210, 1310) is disposed in the flow communication interference condition while the flow communication interference body 1120 (1220, 1320) is disposed within the passage 1116 (1216, 1316).

In some embodiments, for example, the flow communication interference body 1120 (1220, 1320) closes, or substantially closes, the passage 1116 (1216, 1316) of the housing. In some embodiments, for example, the flow communication interference body 1120 (1220, 1320) interferes with flow communication, via the passage 1116 (1216, 1316), between the first and second ends 1110A (1210A, 1310A), 1110B (1210B, 1310B) of the shifting tool 1110 (1210, 1310). In some embodiments, for example, the flow communication interference body 1120 (1220, 1320) seals, or substantially seals, flow communication, via the passage 1116 (1216, 1316), between the first and second ends 1110A (1210A, 1310A), 1110B (1210B, 1310B) of the shifting tool 1110 (1210, 1310). In this respect, the flow communication interference body 1120 (1220, 1320) defines a sealed interface that seals, or substantially seals, flow communication, via the fluid passage 1116 (1216, 1316), between the first and second ends 1110A (1210A, 1310A), 1110B (1210B, 1310B) of the shifting tool 1110 (1210, 1310).

The flow communication interference body 1120 (1220, 1320) can be of any suitable form, including a disc, a plug, a ball, or a dart, so long as the form is conducive for effecting interference with flow communication through the passage 1116 (1216, 1316).

The flow communication interference body 1120 (1220, 1320) is configured for changing its condition relative to the shifting tool 1110 (1210, 1310) such that the shifting tool 1110 (1210, 1310) becomes disposed in the flow communication-effecting condition.

Figure 7:
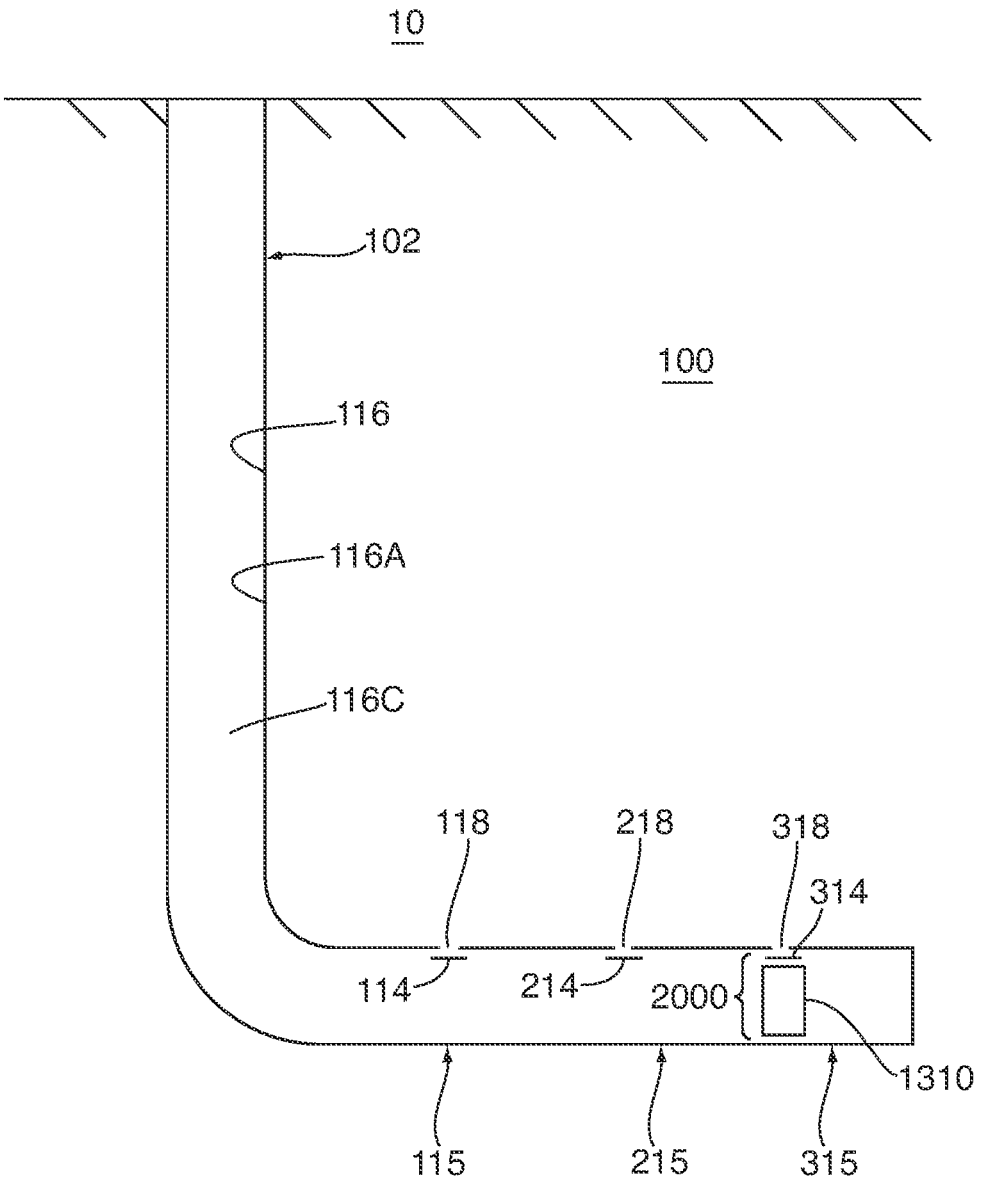
FIGS. 7 to 12 are illustrative of a method for treating a subterranean formation in accordance with the present disclosure.
Figure 8:
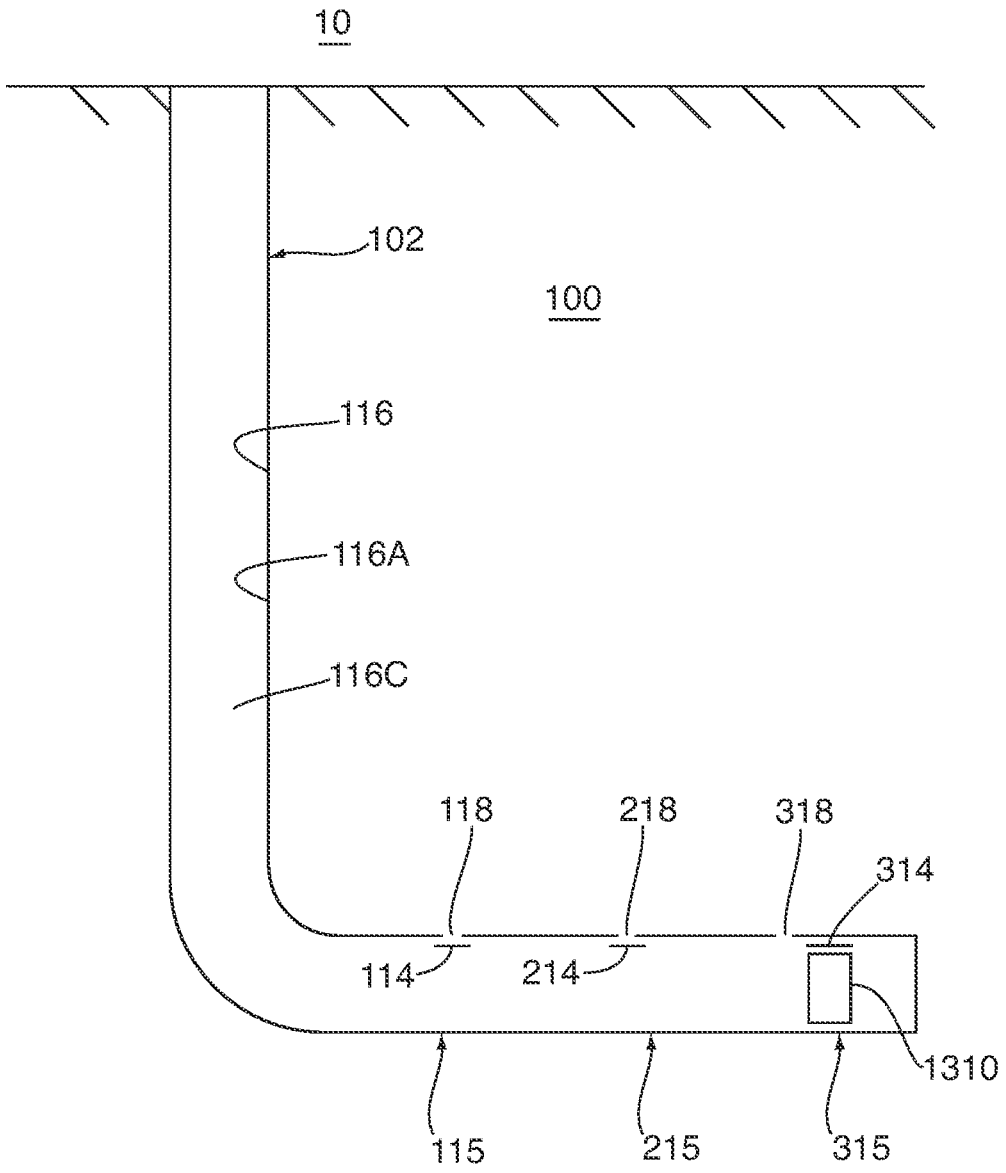
Figure 9:
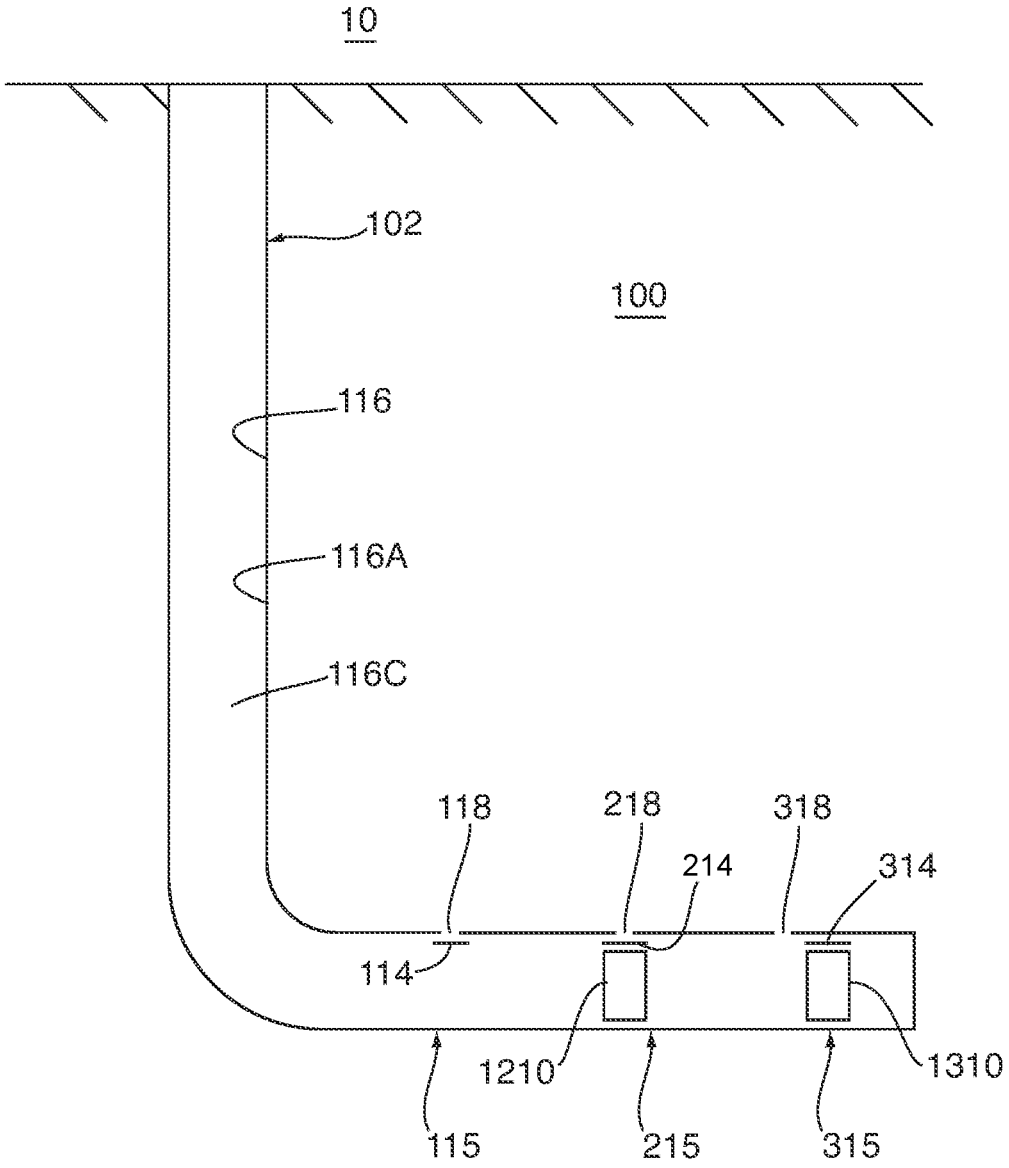
Figure 10:
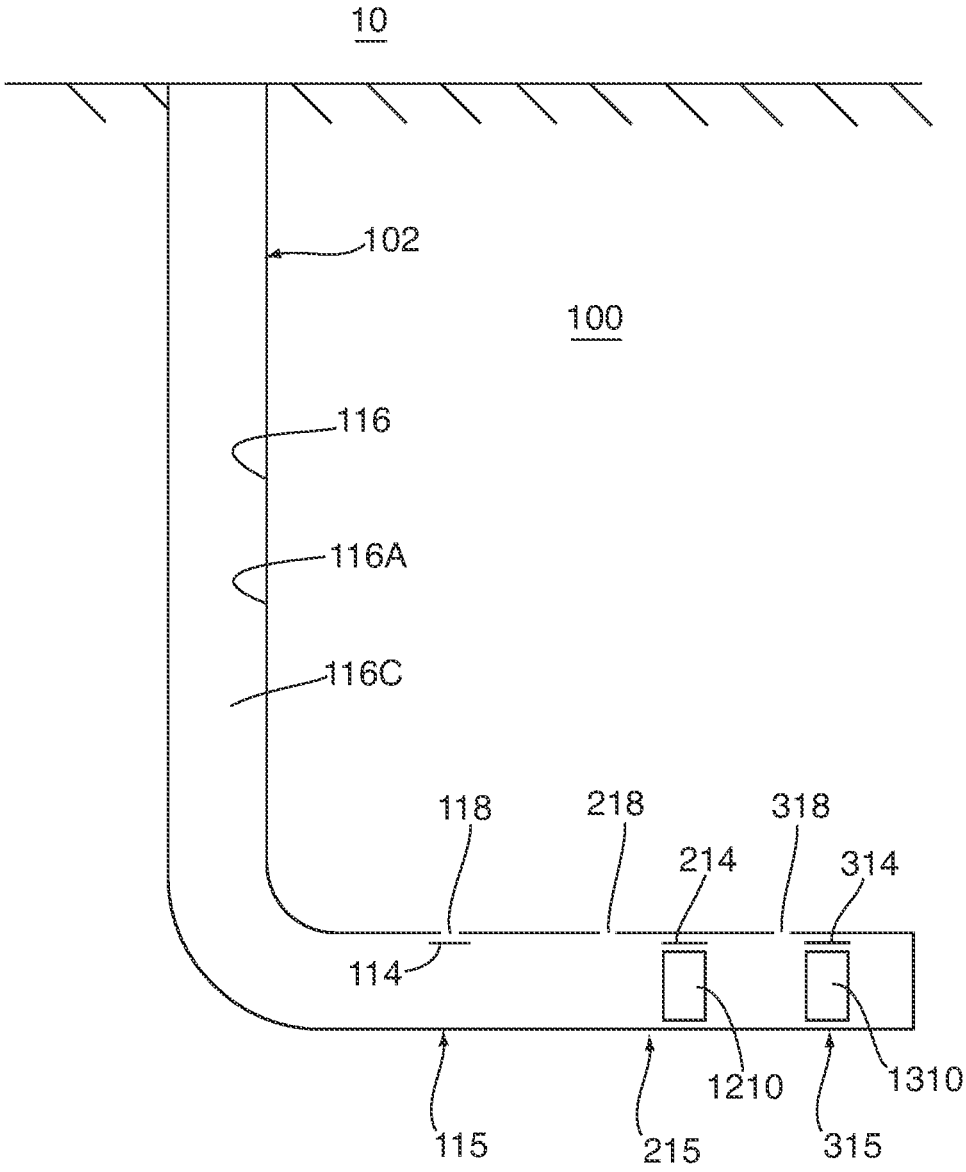
Figure 11:
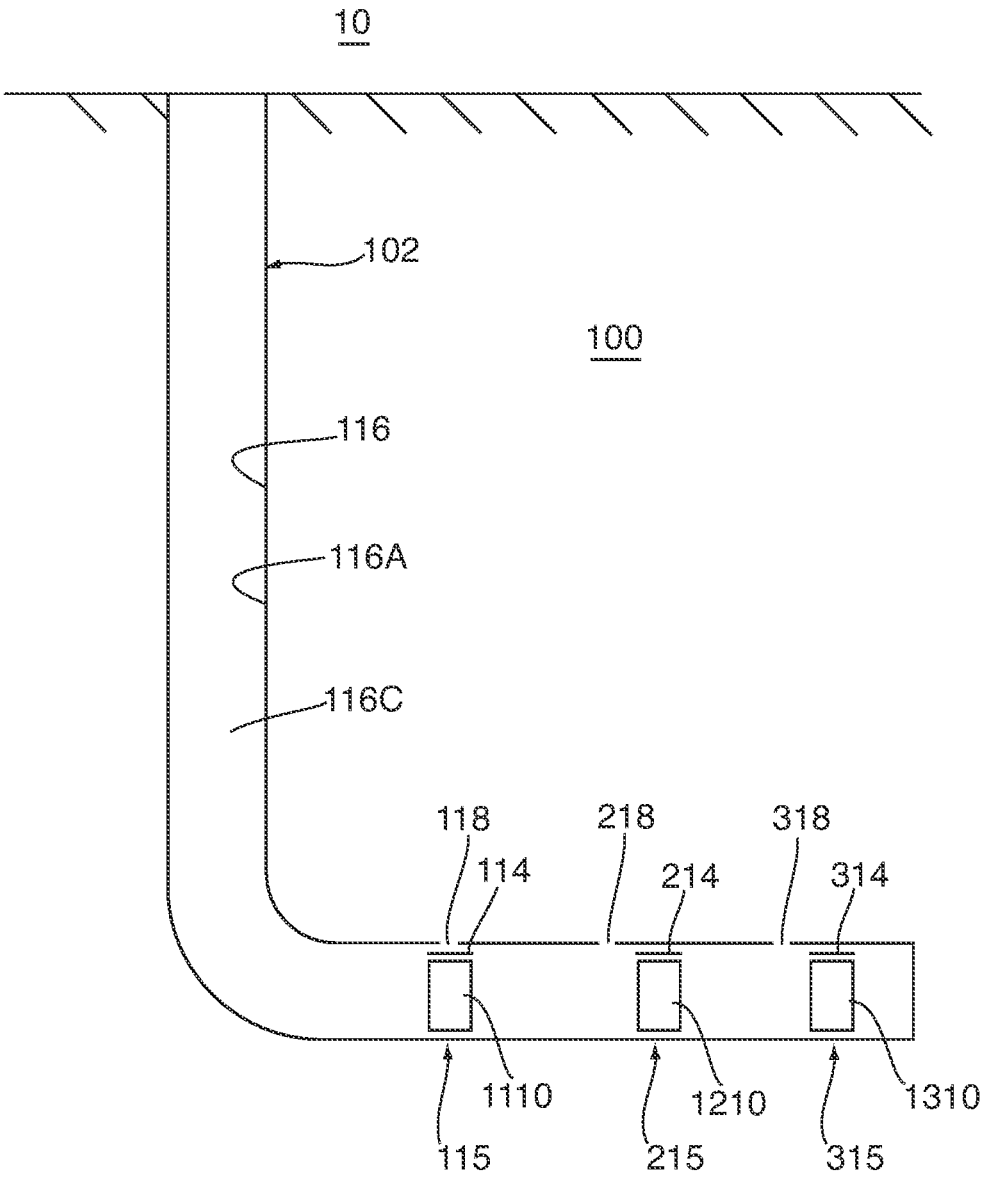
Figure 12:
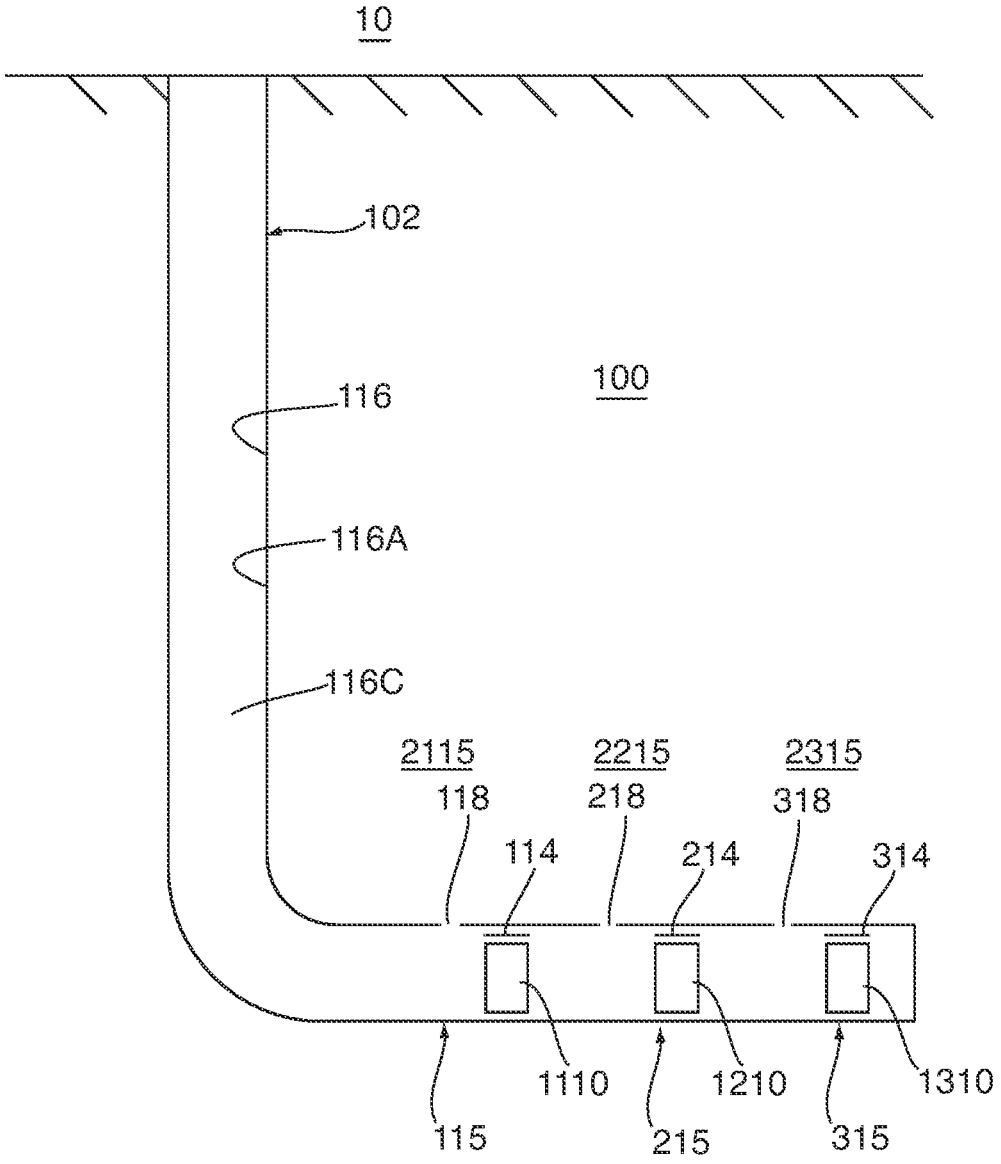

In this respect, in some of these embodiments, for example, the flow communication interference body 1120 (1220, 1320) is configured for degradation in response to contacting with wellbore fluids within the wellbore. In some embodiments, for example, the degradation is with effect that the passage 1116 (1216, 1316) becomes disposed in an open condition (see FIG. 7). In some embodiments, for example, the degradation is with effect that the interference with flow communication, via the passage 1116 (1216, 1316), between the first and second ends 1110A (1210A, 1310A), 1110B (1210B, 1310B) of the shifting tool 1110 (1210, 1310), is removed. In some embodiments, for example, the degradation is with effect that the sealing interface is defeated, such that flow communication becomes established, via the passage 1116 (1216, 1316), between the first and second ends 1110A (1210A, 1310A), 1110B (1210B, 1310B) of the shifting tool 1110 (1210, 1310). In some embodiments, for example, the flow communication interference body 1120 (1220, 1320) is dissolvable in wellbore fluids within the wellbore, such that the degradation includes dissolution of the flow communication interference body 1120 (1220, 1320). In some embodiments, for example, the flow communication interference body 1120 (1220, 1320) is reactive in wellbore fluids within the wellbore, such that the degradation includes chemical degradation of the flow communication interference body 1120 (1220, 1320).

In some embodiments, for example, the flow communication interference body 1120 (1220, 1320) is configured for being disposed for flowback (such as, for example, during production) within the wellbore string passage 116C by fluid pressure, such as, for example, an unbalanced fluid pressure, such that the flow communication interference body 1120 (1220, 1320) is displaceable from the passage 1116 (1216, 1316) of the shifting tool 1110 (1210, 1310), with effect that disposition of the shifting tool 1110 (1210, 1310) in the flow communication-effecting condition is effected.

By providing for the changing in condition of the flow communication interference body 1120 (1220, 1320) such that disposition of the shifting tool 1110 (1210, 1310) in the flow communication-effecting condition is effectible, zones within the subterranean formation are isolatable from the surface during hydraulic fracturing and, after hydraulic fracturing of all zones is completed, can then become disposed in fluid communication with the surface to facilitate production from the subterranean formation.

In some embodiments, for example, the housing of the shifting tool 1110 (1210, 1310) includes a releasable retainer 1122 (1222, 1322) for effecting releasable retention of the flow communication interference body 1120 (1220, 1320) within the passage 1116 (1216, 1316) of the housing. In some embodiments, for example, the retention is with effect that:

(i) release of the flow communication interference body 1120 (1220, 1320), from the housing 1118 (1218, 1318), by displacement of the flow communication interference body 1120 (1220, 1320), relative to the housing, along an axis that is parallel to, or substantially parallel to, a longitudinal axis of the shifting tool 1110 (1210, 1310) (such as, for example, a longitudinal axis of the passage 1116 (1216, 1316) of the shifting tool 1110 (1210, 1310)), is prevented or substantially prevented; and (ii) displacement (such as, for example, in a downhole direction) of the flow communication interference body 1120 (1220, 1320), relative to the flow control member 114 (214, 314), within the passage 1116 (1216, 1316) and along an axis that is parallel to, or substantially parallel to, a longitudinal axis of the passage 1116 (1216, 1316) of the shifting tool 1110 (1210, 1310), to a flow control member coupler retaining position, is prevented or substantially prevented.

The flow communication interference body 1120 (1220, 1320) and the releasable retainer 1122 (1222, 1322) are co-operatively configured such that, while the flow communication interference body 1120 (1220, 1320) is being releasably retained by the releasable retainer, the shifting tool 1110 (1210, 1310) is disposed in the flow communication interference condition.

In some embodiments, for example, the retention is effected by an interference fit relationship between the retainer 1122 (1222, 1322) and the flow communication-interference body 1120 (1220, 1320).

In some embodiments, for example, the retainer extends from the housing into the passage 1116 (1216, 1316). In some embodiments, for example, the retainer 1122 (1222, 1322) is coupled to the housing of the shifting tool 1110 (1210, 1310) by one or more frangible interlocking members 1124 (1224, 1324), such as, for example, one or more shear pins. The one or more frangible interlocking members 1124 (1224, 1324) are configured for fracturing in response to application of a sufficient force, with effect that: (i) the retainer 1122 (1222, 1322) becomes released (such as, for example, separated) from the housing 1118 (1218, 1318), and (ii) the flow communication interference body 1120 (1220, 1320) becomes released from the housing 1118 (1218, 1318) and becomes displaceable within the passage 1116 (1216, 1316), such as, for example, to the flow control member coupler retaining position (see FIG. 5). In this respect, in some embodiments, for example, the retainer 1122 (1222, 1322) is frangible.

In some embodiments, for example, the fracturing is effectible by a fluid pressure, such as, for example, an unbalanced fluid pressure.

In some embodiments, for example, the fracturing is effectible in response to a force applied by the flow communication interference body 1120 (1220, 1320) to the retainer 1122 (1222, 1322), while the flow communication interference body 1120 (1220, 1320) is decelerating in response to coupling of the flow control member 114 (214, 314) to the stop 126 (226, 326) (which has resulted in the corollary deceleration of the flow control member 114 (214, 314) which had been moving after being displaced from the closed position).

In the flow control member coupler retaining position, the flow communication interference body 1120 (1220, 1320) is disposed relative to the flow control member coupler 1112 (1212, 1312) such that, while the flow control member coupler 1112 (1212, 1312) is disposed in the retained position, displacement of the flow control member coupler 1112 (1212, 1312), relative to the flow control member 114 (214, 314), from the retained position to the released position is prevented or substantially prevented by the flow communication interference body 1120 (1220, 1320). In some embodiments, for example, while the flow communication interference body 1120 (1220, 1320) is disposed in the flow control member coupler retaining position, the flow communication interference body 1120 (1220, 1320) is disposed in alignment with the flow control member coupler 1112 (1212, 1312).

In this respect, in some embodiments, for example, while the flow communication interference body 1120 (1220, 1320) is disposed in the flow control member retaining position, release of the flow control member coupler 1112 (1212, 1312) from the flow control member 114 (214, 314) is resisted by the flow communication interference body 1120 (1220, 1320). Also in this respect, in some embodiments, for example, while the flow communication interference body 1120 (1220, 1320) is disposed in the flow control member retaining position, the flow control member coupler 1112 (1212, 1312) is maintained in a coupled relationship with the flow control member 114 (214, 314) by the flow communication interference body 1120 (1220, 1320).

In some embodiments, for example, the shifting tool 1110 (1210, 1310) further includes a stop 1126 (1226, 1326) disposed within the passage 1116 (1216, 1316) for establishing disposition of the flow communication interference body 1120 (1220, 1320) in the flow control member-retaining position, after the flow communication interference body 1120 (1220, 1320) has been released from the retention. In some embodiments, for example, the stop 1126 (1226, 1326) includes a seat, and the seat is configured for seating the flow communication interference body 1120 (1220, 1320) while the flow communication interference body 1120 (1220, 1320) is disposed in the flow control member coupler-retaining position.

The flow communication interference body 1120 (1220, 1320) and the stop 1126 (1226, 1326) are co-operatively configured such that, while the disposition of the flow communication interference body 1120 (1220, 1320) in the flow control member retaining position is being established by the stop (such as, for example, by seating of the flow communication interference body 1120 (1220, 1320) on the seat), the shifting tool 1110 (1210, 1310) is disposed in the flow communication interference condition.

In some embodiments, for example, the flow communication interference body 1120 (1220, 1320) and the stop 1126 (1226, 1326) are further co-operatively configured such that, while the flow communication interference body 1120 (1220, 1320) is being releasably retained by the retainer 1124 (1224, 1324), the stop 1126 (1226, 1326) is disposed downhole relative to the flow communication interference body 1120 (1220, 1320). In this respect, upon release of the flow communication interference body 1120 (1220, 1320) from the releasable retention, displacement of the flow communication interference body 1120 (1220, 1320) is effectible by displacement of the flow communication interference body 1120 (1220, 1320) within the passage 1116 (1216, 1316) in a downhole direction (such as, for example, in response to application of a fluid pressure, such as, for example, an unbalanced fluid pressure).

In some embodiments, for example, the stop 1126 (1226, 1326) and the frangible retainer 1124 (1224, 1324) are co-operatively dimensioned such that, upon release of the retainer 1124 (1224, 1324) from the housing 1118 (1218, 1318), the retainer 1124 (1224, 1324) is conductible (such as, for example, in response to application of an unbalanced fluid pressure), via the passage 1116 (1216, 1316), past the stop 1126 (1226, 1326) (such as, for example, through a port of the seat).

In some embodiments, for example, the flow control member coupler 1112 (1212, 1312) is sufficiently stiff such that it is not necessary to design for the flow communication interference body 1120 (1220, 1320) to become disposed in the flow control member retaining position. In this respect, the flow communication interference body 1120 (1220, 1320) can be disposed closer to the first end (uphole end) 1110A (1210A, 1310A) of the shifting tool 1110 (1210, 1310), or can be disposed closer to the second end (downhole end) 1110B (1210B, 1310B) of the shifting tool 1110 (1210, 1310).

Figure 5A:
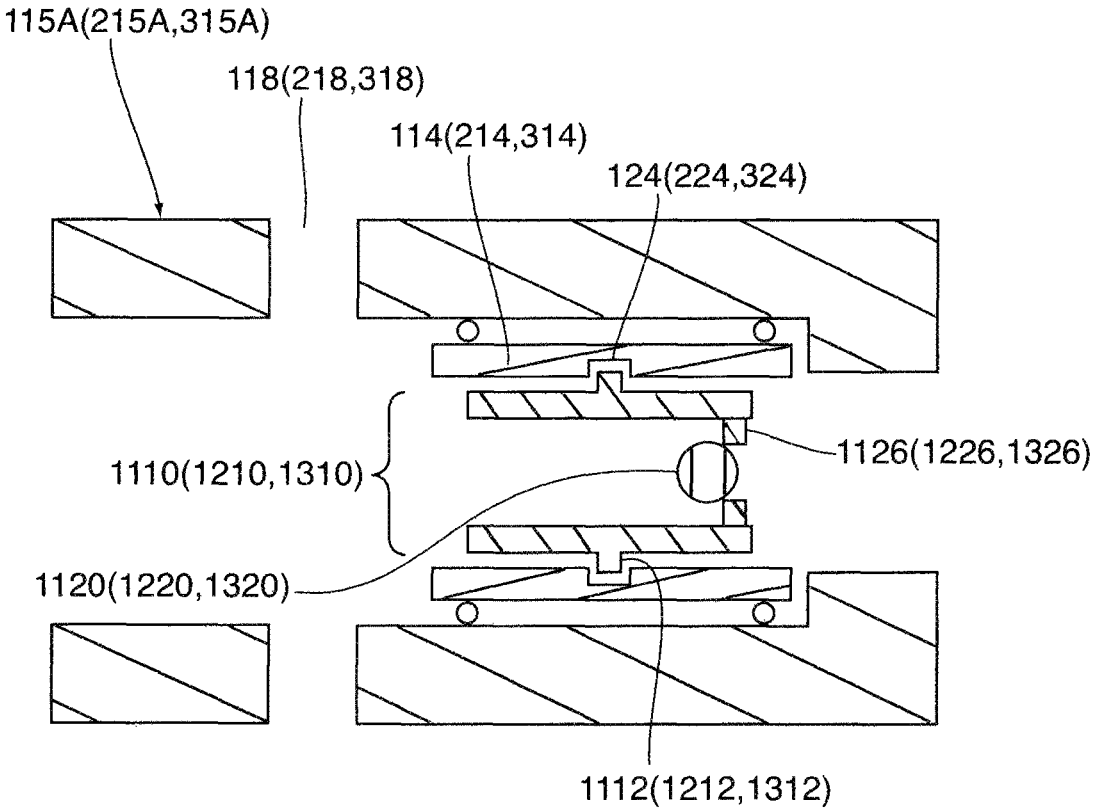
FIG. 5A is a schematic illustration of another embodiment of the assembly illustrated in FIG. 2, with the hard stop disposed at a downhole end of the shifting tool, and illustrating the flow communication interference body having become released and seated against the hard stop.

Referring to FIG. 5A, in some embodiments, for example, where the shifting tool 1110 (1210, 1310) includes one or more resilient members 1114 (1214, 1314) (such as one or more collet springs) that exert a biasing force for effecting the biasing of the flow control member coupler 1112 (1212, 1312) to the retained position, relative to the receiving profile 124 (224, 324), the flow communication interference body 1120 (1220, 1320) is retained within the passage 1116 (1216, 1316) closer to the second end (the downhole end) of the shifting tool 1110 (1210, 1310) and supporting at least one of the resilient members 1114 (1214, 1314). In some embodiments, for example, the flow communication interference body 1120 (1220, 1320) is disposed between the flow control member coupler 1112 and the second end (the downhole end) of the shifting tool 1110 (1210, 1310). In some embodiments, for example, by virtue of this configuration, the resilient members 114 (1214, 1314) would be disposed in tension when, while being displaced from the closed position, the flow control member 114 (214, 314) becomes coupled to the stop 126 (226, 326). By being disposed in tension, as opposed to compression, buckling of the resilient members 114 (1214, 1314) is mitigated, which, in turn, mitigates inadvertent release of the flow control member coupler 1112 (1212, 1312) from the receiving profile 124 (224, 324). In some of these embodiments, for example, the flow communication interference body 1120 (1220, 1320) is retained in this position by securement relative to the housing, closer to the downhole end of the shifting tool 1110 (1210, 1310). In some embodiments, for example, the flow communication interference body 1120 (1220, 1320) becomes retained in this position, closer to the downhole end of the shifting tool 1110 (1210, 1310), in response to being urged against the stop 1126 (1226, 1326) by fluid pressure, after having been released from the retainer 1124 (1224, 1324).

In some embodiments, for example, the flow control apparatus 115A (215A, 315A) includes a key profile, and the shifting tool 1110 (1210, 1310) includes a matching key. The coupling of the flow control member coupler 1112 (1212, 1312) to the flow control member 114 (214, 314) is effectible in response to registration of the key profile with the matching key. In some embodiments, for example, the key profile is defined by the receiving profile 124 (224, 324) of the flow control member 114 (214, 314), and the matching key is defined by the flow control member coupler 1112 (1212, 1312) of the shifting tool 1110 (1210, 1310).

Referring to FIGS. 1 to 6, in some embodiments, for example, a system is provided including a plurality of flow communication stations 115, 215, 315 (three are shown) and a corresponding plurality of shifting tools 1010, 1110, 1210. The flow communication stations 115, 215, 315 are spaced apart along the wellbore string 116. Each one of the flow communications 115, 215, 215, independently, includes a respective flow control apparatus 115A, 215A, 315A, and each one of the flow control apparatuses includes a respective key profile. Each one of the shifting tools 1010, 1110, 1210, independently, includes a respective key. In some embodiments, for example, for each one of the flow control apparatuses, independently, the respective key profile of the flow control apparatus is registrable with a matching key of a shifting tool 1110 (1210, 1310) ("matching shifting tool 1110 (1210, 1310)") such that the matching shifting tool 1110 (1210, 1310) is disposed for coupling to the flow control member 114 (214, 314) of the flow control apparatus 115A, 215A, 315A in response to registration of the matching key with the key profile of the flow control member 114 (214, 314) of the flow control apparatus.

Referring to FIGS. 3 to 12, in some embodiments, for example, the flow communication stations 115, 215, 315 are spaced apart along the wellbore string in a sequence. For each one of the plurality of flow communication stations 115, 215, 315 in the sequence, independently, the flow communication station includes a flow control apparatus 115A (215A, 315A) that corresponds to a respective one of the shifting tools 1010, 1110, 1210 (the "respective shifting tool"). The respective shifting tool 1110 (1210, 1310) includes a respective key that is registrable with (i.e. matches) a respective key profile of the flow control apparatus 115A (215A, 315A) such that the respective shifting tool 1110 (1210, 1310) is disposed for coupling to the flow control member 114 (214, 314) of the flow control apparatus 115A (215A, 315A) in response to registration of the respective key with the respective key profile of the flow control apparatus 115A (215A, 315A), and that is not registrable with (i.e. does not match) the key profile of the flow control apparatus of the other flow communication stations (the "uphole-disposed flow communication stations") that are disposed uphole of the flow communication station 115 (215, 315) (i.e. the flow communication station that includes the flow control apparatus 115A (215A, 315A) including the key profile to which the respective key is registrable), such that there is an absence of coupling of the respective shifting tool 1110 (1210, 1310) to the uphole-disposed flow communication stations as the respective shifting tool 1110 (1210, 1310) is conveyed, via the wellbore string passage 116C, past the uphole-disposed flow communication stations. In some embodiments, for example, the respective key of the respective shifting tool 1110 (1210, 1310) can be registrable with a key profile of a flow control apparatus of one or more of the other flow communication stations that are disposed downhole of the flow communication station 115 (215, 315) (i.e. the flow communication station that includes the flow control apparatus 115A (215A, 315A) including the key profile to which the respective key is registrable).

In the absence of the above-described co-operative configuration of the flow communication stations 115, 215, 315 and the shifting tools 1010, 1110, 1210, downhole flow communication stations may be blocked from becoming coupled to a shifting tool 1110 (1210, 1310) (by shifting tools that have been previously coupled to flow control members associated with uphole-disposed flow communication stations), and may, therefore, impede hydraulic fracturing and subsequent production of downhole zones in the subterranean formation.

In this respect, in the embodiment illustrated in FIGS. 7 to 12, the furthest downhole flow communication station is the flow communication station 315, and the respective shifting tool 1310 is conveyable past the flow control apparatuses that are respective to the other ones of the flow communication stations 115, 215, without having its key 1312 register with the key profiles 124, 224 of the flow control apparatuses 115A, 215A (because such key is a mismatch with such key profiles), and, as such, without coupling to the flow control members 114, 214 of the flow control apparatuses of the flow communication stations 115, 215. The flow communication station, that is disposed immediately uphole of the furthest downhole flow communication station 315, is the flow communication station 215, and the respective shifting tool 1210 is conveyable past the flow control apparatus 115A of the uphole-disposed flow communication station 115, without having its key 1212 register with the key profile 224 of the flow control apparatus 215 (because such key is a mismatch with such key profiles), and, as such, without coupling to the flow control member 214 of the flow control apparatus 215A of the flow communication station 215. The next (and last) uphole flow communication station is the flow communication station 115, and the respective shifting tool 1110 not required to be conveyed past any other flow communication stations (without having its key ignore, and fail to register with, a key profile of another flow control apparatus), and is merely disposed for its key 1112 to register with the key profile 124 of the flow control apparatus 115A of the flow communication station 115. In some embodiments, for example, the key 1212 is also registrable with the key profile 324. In some embodiments, for example, the key 1112 is also registrable with one or both of the key profiles 224, 324.

In some embodiments, for example, registration of the key 1112 (1212, 1312) of a shifting tool 1110 (1210, 1310) to a key profile 124 (224, 324) of a flow control apparatus 115A (215A, 315A) is based on correspondence between the geometry of the flow control member coupler 1112 (1212, 1312) of the shifting tool 1110 (1210, 1310) and the geometry of the receiving profile 124 (224, 324) of the flow control member 114 (214, 314). In some embodiments, for example, the registration is based on correspondence between a dimension of the flow control member coupler 1112 (1212, 1312) of the shifting tool 1110 (1210, 1310) and a dimension of the receiving profile 124 (224, 324) of the flow control member 114 (214, 314). In some embodiments, for example, the registration is based on correspondence between a width of the flow control member coupler 1112 (1212, 1312) of the shifting tool 1110 (1210, 1310) and the width of the receiving profile 124 (224, 324) of the flow control member 114 (214, 314). In this respect, where the registration is based on correspondence between a width of the flow control member coupler 1112 (1212, 1312) (e.g. protuberance) of the shifting tool 1110 (1210, 1310) and the width of the receiving profile 124 (224, 324) (e.g. recess) of the flow control member 114 (214, 314), the width of the flow control member coupler 1112 (1212, 1312) of the shifting tool 1110 (1210, 1310), that is registrable with the receiving profile 124 (224, 324) (e.g. is receivable by the recess) of the flow control member 114 (214, 314) of the flow control apparatus 115A (215A, 315A) of a flow communication station 115 (215, 315) (e.g. is receivable by the groove of the flow control member 114 (214, 314)), is wider than the receiving profile (e.g. recess) of the flow control member of the flow control apparatus of every other flow communication station that is disposed further uphole.

A method of producing reservoir fluid from a subterranean formation, with the above-described system, where the flow communication stations 115, 215, 315 are spaced apart along the wellbore string 116 in a sequence, will now be described.

Referring to FIGS. 7 to 12, the shifting tools 1110, 1210, 1310 are sequentially conveyed downhole such that each one of the flow control members 114, 214, 314, independently, becomes coupled to a respective shifting tool 1110 (1210, 1310) while the flow control member 114 (214, 314) disposed in a closed position, in sequence. In this respect, for each one of the flow communication stations 115, 215, 315, independently, coupling of a respective shifting tool 1110 (1210, 1310) to the flow control member 114 (214, 314) of the flow control apparatus 115A (215A, 315A) of each one of the flow communication stations 115, 215, 315 is effected, in sequence. In some embodiments, for example, the conveying is effected by pumping the shifting tools 1110, 1210, 1310 downhole with a fluid, in sequence. In this respect, prior to pumping down of the first shifting tool 1110 (1210, 1310), flow communication is established between the surface and the subterranean formation via an opened toe sleeve, so that flow is establishable within the wellbore string passage 116C.

After each one of the sequential couplings, independently, and prior to the succeeding couplings in the sequence, the flow control member 114 (214, 314) is displaced by the shifting tool 1110 (1210, 1310) from the closed position to the open position (such as, for example, by the application of fluid pressure to the displacement-ready flow control member assembly 2000, such as, for example, an unbalanced fluid pressure) such that the one or more ports 118 (218, 318) of the flow control apparatus 115A (215A, 315A) become opened, and treatment material is injected from the surface, via the wellbore string passage and the one or more opened ports 118 (218, 318), and into the subterranean formation 100, such that treatment material is injected, in sequence, through each one of the flow communication stations 115, 215, 315, independently.

After the treatment material has been injected through all of the flow communication stations 115, 215, 315, for each one of the flow communication stations 115, 215, 315, independently, a change in condition of the flow communication interference body 1120 (1220, 1320) is effected such that the shifting tool 1110 (1210, 1310) becomes disposed in the flow communication-effecting condition, with effect that flow communication, via the passage 132 (232, 332), between the uphole end 115B (215B, 315B) of the flow control apparatus 115A (215A, 315A) and the downhole end 115C (215C, 315C) of the flow control apparatus 115A (215A, 315A), is established, such that flow communication is established, via the flow communication stations 115, 215, 315, between the subterranean formation 100 and the wellbore string passage 116C. In some embodiments, for example, the change in condition of the flow communication interference body 1120 (1220, 1320) is effected by degradation of the flow communication interference body 1120 (1220, 1320).

After the flow communication has been established, via the flow communication stations 115, 215, 315, between the subterranean formation 100 and the wellbore string passage 116C, reservoir fluid, received by the wellbore string passage 116C from the subterranean formation 100, via the flow communication stations 115, 215, 315 is produced at the surface 10.

Relatedly, and again referring to the embodiment illustrated in FIGS. 7 to 12, a method of producing reservoir fluid using the system 104 illustrated in FIGS. 7 to 12 will now be described. The shifting tool 1310 is pumped down the wellbore string passage 116C. Because the key 1312 of the shifting tool 1310 does not match the key profiles of the flow control apparatuses 115A, 215A associated with the flow communication stations 115, 215, the shifting tool 1110 (1210, 1310) passes the flow communication stations 115, 215 without becoming coupled to the associated flow control members 114, 214 (i.e. the shifting tool 1310 ignores the flow communication stations 115, 215). Because the key 1312 of the shifting tool 1310 matches the key profile 324 of the flow control apparatus 315A associated with the flow communication station 315, upon alignment of the flow control member coupler 1312 of the shifting tool 1310 and the receiving profile 124 of the flow control member 314, the flow control member coupler 1312 becomes disposed within the receiving profile 124, thereby effecting coupling of the shifting tool 1310 to the flow control member 314 associated with the flow communication station 315 (see FIG. 7). After the coupling, the flow control member 314 is displaced to the open position by the shifting tool 1310, such as, for example, in response to applied fluid pressure (such as, for example, an unbalanced fluid pressure), with effect that the one or more ports 318 associated with the flow communication station 315 become opened (see FIG. 8). Treatment material is then injected through the one or more opened ports 318 associated with the flow communication station 315, thereby effecting treatment of the zone 2315 of the subterranean formation 100 associated with the flow communication station 315.

After the treatment of the zone 2315 of the subterranean formation 100 associated with the flow communication station 315, and while the one or more ports 318 associated with the flow communication station 315 are opened, the shifting tool 1210 is pumped down the wellbore string passage 116C. Because the key 1212 of the shifting tool 1210 does not match the key profile 124 of the flow control apparatus 115A associated with the flow communication station 115, the shifting tool 1210 passes the flow communication station 115 without becoming coupled to the associated flow control member 214 (i.e. the shifting tool 1210 ignores the flow communication station 115). Because the key 1212 of the shifting tool 1210 matches the key profile 224 of the flow control apparatus 215A associated with the flow communication station 215, upon alignment of the flow control member coupler 1212 of the shifting tool 1210 and the receiving profile 224 of the flow control member 214, the flow control member coupler 1212 becomes disposed within the receiving profile 224, thereby effecting coupling of the shifting tool 1210 to the flow control member 214 associated with the flow communication station 215 (see FIG. 9). After the coupling, the flow control member 214 is displaced to the open position by the shifting tool 1210, such as, for example, in response to applied fluid pressure (such as, for example, an unbalanced fluid pressure), with effect that the one or more ports 218 associated with the flow communication station 215 become opened (see FIG. 10). Treatment material is then injected through the one or more opened ports 218 associated with the flow communication station 215, thereby effecting treatment of the zone 2215 of the subterranean formation 100 associated with the flow communication station 215.

After the treatment of the zone 2215 of the subterranean formation 100 associated with the flow communication station 215, and while the one or more ports 218 associated with the flow communication station 215 are opened, the shifting tool 1110 is pumped down the wellbore string passage 116C. Unlike the preceding shifting tools 1210, 1310, the shifting tool 1110 is not conveyed past any non-corresponding flow communication stations. Because the key of the shifting tool 1110 matches the key profile 124 of the flow control apparatus 115A associated with the flow communication station 115, upon alignment of the flow control member coupler 1112 of the shifting tool 1110 with the receiving profile 124 of the flow control member 114, the flow control member coupler 1112 becomes disposed within the receiving profile 124, thereby effecting coupling of the shifting tool 1110 to the flow control member 114 associated with the flow communication station 115 (see FIG. 11). After the coupling, the flow control member 114 is displaced to the open position by the shifting tool 1110, such as, for example, in response to applied fluid pressure (such as, for example, an unbalanced fluid pressure), with effect that the one or more ports 118 associated with the flow communication station 115 become opened (see FIG. 12). Treatment material is then injected through the one or more opened ports 118 associated with the flow communication station 115, thereby effecting treatment of the zone 2115 of the subterranean formation 100 associated with the flow communication station 115.

As a result, treatment material has been received by the zones 2115, 2215, 2315 of the subterranean formation associated with the flow communication stations 115, 215, 315, After sufficient time has elapsed such that the zones 2115, 2215, 2315 of the subterranean formation have become sufficiently treated by the treatment material, a change in condition of the flow communication interference bodies 1120, 1220, 1320 is effected (such as, for example, by degradation of the flow communication interference bodies) such that the shifting tools 1110 1210, 1310 becomes disposed in the flow communication-effecting condition, with effect flow communication is established, via flow communication stations 115, 215, 315, between the subterranean formation and the wellbore string passage 116C, and reservoir fluid is producible from the zones 2115, 2215, 2315 of the subterranean formation via the flow communication stations 115, 215, 315.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

The invention claimed is:

1. Apparatuses of a flow communication station, comprising:

a flow control apparatus including:

an apparatus passage extending from an uphole end of the flow control apparatus to a downhole end of the flow control apparatus;

one or more ports;

a flow control member displaceable relative to the one or more ports for effecting opening of the one or more ports such that flow communication is effectible between the apparatus passage and the one or more ports; and a receiving profile defined within the flow control member;

and a shifting tool including:

a flow control member coupler for coupling to the flow control member of the flow control apparatus;

a shifting tool passage extending from an uphole end of the shifting tool to a downhole end of the shifting tool;

a flow communication interference body disposed within the shifting tool passage and interfering with flow communication, via the shifting tool passage, between the uphole and downhole ends of the shifting tool, a releasable retainer for effecting releasable retention of the flow communication interference body within the shifting tool passage; and a stop for establishing disposition of the flow communication interference body within the shifting tool passage, after the flow communication interference body has been released from the retention.

2. The apparatuses as claimed in claim 1;

wherein:

the established disposition of the flow communication interference body within the shifting tool passage is a flow control member coupler retaining position; and in the flow control member coupler retaining position, the flow communication interference body is disposed relative to the flow control member coupler such that, while the flow control member coupler is coupled to the flow control member, release of the flow control member from coupling to the flow control member is resisted by the flow communication interference body.

3. The apparatuses as claimed in claim 2;

wherein the flow communication body is co-operatively configured with the flow control member coupler such that displacement of the flow control member coupler, relative to the flow control member, from the retained position to the released position is prevented or substantially prevented by the flow communication interference body while the flow communication body is disposed in the flow control member coupler retaining position.

4. The apparatuses as claimed in claim 2;

wherein the flow communication body is co-operatively configured with the flow control member coupler such that, while the flow communication interference body is disposed in the flow control member coupler retaining position, the flow communication interference body is disposed in alignment with the flow control member coupler.

5. The apparatuses as claimed in claim 2;

wherein the flow communication interference body and the stop are co-operatively configured such that, while the disposition of the flow communication interference body in the flow control member-retaining position is being established by the stop, the shifting tool is disposed in the flow communication interference condition.

6. The apparatuses as claimed in claim 1;

wherein the established disposition of the flow communication interference body within the shifting tool passage is between the flow control member coupler and a downhole end of the shifting tool.

7. The apparatuses as claimed in claim 1;

wherein:

the flow control member includes a retaining profile;

the flow control member coupler is biased for disposition within the receiving profile for coupling to the flow control member.

8. The apparatuses as claimed in claim 1;

wherein the retention is with effect that:

(i) release of the flow communication interference body, from the housing, by displacement of the flow communication interference body, relative to the housing, along an axis that is parallel to, or substantially parallel to, a longitudinal axis of the shifting tool, is prevented or substantially prevented; and (ii) displacement of the flow communication interference body, relative to the flow control member, within the shifting tool passage and along an axis that is parallel to, or substantially parallel to, the longitudinal axis of the shifting tool, to a flow control member coupler retaining position, is prevented or substantially prevented.

9. The apparatuses as claimed in claim 1;

wherein the retention is effected by an interference fit relationship between the retainer and the communication-interference body.

10. The apparatuses as claimed in claim 1;

wherein the releasable retainer is frangible.

11. The apparatuses as claimed in claim 1;

wherein the shifting tool is disposable from a flow communication interference condition to a flow communication-effecting condition.

12. The apparatuses as claimed in claim 11;

wherein the flow communication interference body and the releasable retainer are co-operatively configured such that, while the flow communication interference body is being releasably retained by the releasable retainer, the shifting tool is disposed in the flow communication interference condition.

13. The apparatuses as claimed in claim 11;

wherein the flow communication interference body and the shifting tool passage are co-operatively configured such that the shifting tool is disposed in the flow communication interference condition while the flow communication interference body is disposed within the shifting tool passage.

14. The apparatuses as claimed in claim 11;

wherein the flow communication interference body is configured for changing a condition of the flow communication interference body relative to the shifting tool such that the shifting tool becomes disposed in the flow communication-effecting condition.

15. The apparatuses as claimed in claim 14;

wherein the flow communication interference body is degradable in response to exposure to wellbore fluids within a wellbore.

16. The apparatuses as claimed in claim 11;

wherein the flow control member and the shifting tool are co-operatively configured such that, while: (i) the shifting tool is coupled to the flow control member, and (ii) the shifting tool is disposed in the flow communication interference condition, the flow control apparatus passage is closed or substantially closed.

17. The apparatuses as claimed in claim 11;

wherein the flow control member and the shifting tool are co-operatively configured such that, while: (i) the shifting tool is coupled to the flow control member, and (ii) the shifting tool is disposed in the flow communication-effecting condition, flow communication, via the apparatus passage, between the uphole end of the flow control apparatus and the downhole end of the flow control apparatus, is established.

18. Apparatuses of a flow communication station, comprising:

a flow control apparatus including:

a passage extending from an uphole end of the flow control apparatus to a downhole end of the flow control apparatus;

one or more ports;

a flow control member displaceable relative to the one or more ports for effecting opening of the one or more ports such that flow communication is effectible between the passage and the one or more ports; and a receiving profile defined within the flow control member;

a stop for limiting displacement of the flow control member relative to the one or more ports;

a shifting tool including a flow control member coupler biased by one or more resilient members for coupling to the flow control member of the flow control apparatus;

wherein the flow control member and the flow control member coupler are co-operatively configured such that: (i) a displacement-ready flow control member assembly is defined while the flow control member coupler is coupled to the flow control member, and (ii) the displacement-ready flow control member assembly includes the flow control member and the flow control member coupler, and an energy absorber configured for absorbing energy from the displacement-ready flow control member assembly while the displacement-ready flow control member assembly is in motion while being displaced from the closed position and is being decelerated by the stop;

wherein the energy absorber is configured such that at least 75% of the kinetic energy of the displacement-ready flow control member assembly, being displaced, is absorbed by the energy absorber.

19. The apparatuses as claimed in claim 18;

wherein the energy absorber includes a brake.

20. The apparatuses as claimed in claim 18;

wherein the energy absorber is defined by a crumple zone of the flow control member.

21. Apparatuses of a flow communication station, comprising:

a flow control apparatus including:

a passage extending from an uphole end of the flow control apparatus to a downhole end of the flow control apparatus;

one or more ports;

a flow control member displaceable relative to the one or more ports for effecting opening of the one or more ports such that flow communication is effectible between the passage and the one or more ports; and a receiving profile defined within the flow control member;

a stop for limiting displacement of the flow control member relative to the one or more ports;

a shifting tool including a flow control member coupler biased by one or more resilient members for coupling to the flow control member of the flow control apparatus;

wherein the flow control member and the flow control member coupler are co-operatively configured such that: (i) a displacement-ready flow control member assembly is defined while the flow control member coupler is coupled to the flow control member, and (ii) the displacement-ready flow control member assembly includes the flow control member and the flow control member coupler, and a frictionally-engaging portion that is configured for frictionally engaging the flow control member, such that the frictionally engaging portion becomes disposed in an interference fit relationship with the flow control member, as the flow control member is being displaced by the shifting tool from the closed position;

wherein the flow control member and the frictionally-engaging portion are co-operatively configured such that, while flow control member is being displaced from the closed position, the distance over which the flow control member is displaced, while disposed in an interference fit relationship with the frictionally-engaging portion, is at least 0.1 inches.

* * * * *